US008340556B2

(12) United States Patent
Kunihiro et al.

(10) Patent No.: US 8,340,556 B2
(45) Date of Patent: Dec. 25, 2012

(54) TONER CARTRIDGE WITH TONER STIRRING SECTION INCLUDING A FIRST ROTATING BODY AND SECOND ROTATING BODY AND IMAGE FORMING APPARATUS INCLUDING THE SAME

(75) Inventors: Hisashi Kunihiro, Osaka (JP); Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 223 days.

(21) Appl. No.: 12/821,314

(22) Filed: Jun. 23, 2010

(65) Prior Publication Data

US 2011/0026974 A1 Feb. 3, 2011

(30) Foreign Application Priority Data

Jul. 31, 2009 (JP) ..... 2009-180115

(51) Int. Cl.
*G03G 15/08* (2006.01)

(52) U.S. Cl. ..... 399/263

(58) Field of Classification Search ..... 399/263, 399/256, 254

See application file for complete search history.

(56) References Cited

U.S. PATENT DOCUMENTS

2005/0100367 A1* 5/2005 Uratani et al. ..... 399/254

FOREIGN PATENT DOCUMENTS

| | | |
|---|---|---|
| JP | 3-107969 | 5/1991 |
| JP | 11-160985 | 6/1999 |
| JP | 2001-290350 | 10/2001 |
| JP | 2004-264674 A | 9/2004 |
| JP | 2005-77761 A | 3/2005 |

* cited by examiner

*Primary Examiner* — Walter L Lindsay, Jr.
*Assistant Examiner* — Billy J Lactaoen
(74) *Attorney, Agent, or Firm* — Renner, Otto, Boisselle & Sklar, LLP

(57) ABSTRACT

A toner stirring section provided in a toner cartridge includes a first rotating body and a second rotating body. The first rotating body is rotated around an axis J13 to stir a toner. The second rotating body includes a conveying sheet for conveying the toner to a toner replenishing roller which is a conveying destination, to be rotatably provided around the axis J13, and to rotate by being pressed by the first rotating body being rotated. The first rotating body and the second rotating body are provided so that the first rotating body presses the second rotating body after the first rotating body is rotated by a predetermined degrees relative to the second rotating body.

4 Claims, 17 Drawing Sheets

TONER CARTRIDGE WITH TONER STIRRING SECTION INCLUDING A FIRST ROTATING BODY AND SECOND ROTATING BODY AND IMAGE FORMING APPARATUS INCLUDING THE SAME

CROSS-REFERENCE TO RELATED APPLICATION

This application claims priority to Japanese Patent Application No. 2009-180115, which was filed on Jul. 31, 2009, the contents of which are incorporated herein by reference in its entirety.

BACKGROUND OF THE INVENTION

1. Field of the Invention

The present invention relates to a toner cartridge and an image forming apparatus including the same.

2. Description of the Related Art

An image forming apparatus for forming an image using electrophotography is able to form a high quality image with a simple operation and maintenance thereof is easy, and therefore, is used for a copier, a printer, a facsimile and the like to be widely prevalent. A general electrophotographic image forming apparatus is comprised mainly of an image bearing member on which an electrostatic latent image is to be formed, a developing section which develops the electrostatic latent image with a toner, a transfer section which transfers the developed toner image onto recording paper, and a fixing section which fixes the toner image transferred onto the recording paper.

In this manner, in the image forming apparatus using the toner, it is necessary to replenish the toner when the toner contained in the apparatus is consumed to be exhausted. Since the toner is an aggregate of toner particles which are extremely fine and light-weight, when the toner is replenished to the image forming apparatus, the toner particles are likely to scatter in the air, thus the apparatus itself and surroundings thereof become contaminated in some cases. Accordingly, in recent years, a method of replacing an entire toner cartridge using a container-like toner cartridge capable of containing the toner inside thereof, that is, a method of detaching the toner cartridge running out of the toner from a main body of the image forming apparatus and attaching a new toner cartridge filled with a toner is prevailing.

FIG. 16 is a cross-sectional view showing an unused toner cartridge 200 according to a conventional art. The toner cartridge 200 which is unused, that is, in an initial state is attached to the main body of the image forming apparatus replacing the toner cartridge that has been already attached to the main body of the image forming apparatus running out of the toner.

The toner cartridge 200 includes a casing 202 which contains a toner 201, a toner stirring section 203 which stirs and conveys the toner 201, and a toner replenishing roller 204 which is provided above an upper surface of the toner 201.

The toner stirring section 203 is rotatably supported by the casing 202 around a predetermined axis J203. Specifically, included are a cylindrical shaft section 211 extending along the axis J203, two plate-like stirring blades 212*a* and 212*b* which are provided in a protruding state on an outer circumferential surface of the shaft section 211 and departing from each other in a circumferential direction by 180 degrees, and a conveying sheet 213 which is a sheet-like member having flexibility and provided by being fixed to a loose end part of the stirring blade 212*a* that is one of the blades.

The toner stirring section 203 which is configured in this manner is rotated in a direction of an arrow R3 by a motor (not shown) mounted on the main body of the image forming apparatus. The toner stirring section is configured so that the stirring blades 212*a* and 212*b* stir the toner 201 which is contained in the casing 202 and so that the conveying sheet 213 conveys the toner 201 to the toner replenishing roller 204 which is provided on a rear stage side. In particular, the conveying sheet 213 is provided so as to scoop a part of the toner 201 contained in the casing 202 and throw the scooped toner 201 toward the toner replenishing roller 204, and thereby convey the toner 201 to the toner replenishing roller 204.

In addition, the toner replenishing roller 204 extends along an axis J204 which is parallel to the axis J203, and is rotatably supported by the casing 202 around the axis J204. The toner replenishing roller 204 is provided adjacent to a toner replenishing port 205 which is formed on the casing 202. The toner replenishing roller 204 is rotated in a direction of an arrow R4 by a motor (not shown) which is mounted on the main body of the image forming apparatus. The toner replenishing roller 204 is rotated in the rotational direction R4 and thereby supplies the toner 201 that has been conveyed by the toner stirring section 203 to a developing device (not shown) which is mounted on the main body of the image forming apparatus though the toner replenishing port 205.

Usually, an unused toner cartridge 200 is packed in a box and kept in an empty space or a depository until it becomes necessary to replace a toner cartridge. In addition, a position of the toner cartridge 200 during keeping is diverse. For example, the toner cartridge 200 is kept in a position similar to a position in a state attached to the image forming apparatus (hereinafter, also referred to as "horizontal position") in some cases, or kept in a position where the axis J203 is parallel to a vertical direction (hereinafter, also referred to as "vertical position") in other cases.

In any case, the toner 201 contained in the casing 202 is in a compressed state by gravity acting on the toner 201 when kept in a state of maintaining a fixed position over a long term. In particular, it is likely to become a more compressed state when kept in the vertical position compared to being kept in the horizontal position. In addition, a toner agglomerate of aggregated toner particles is likely to be generated depending on an environment in which the toner cartridge 200 is kept.

As shown in FIG. 16, in the toner cartridge 200 in an initial state, since a large amount of the toner 201 is contained in the casing 202, a part of the toner stirring section 203 is provided in a state of being immersed in the toner 201. Accordingly, when kept in the state of maintaining a fixed position over a long term, the conveying sheet 213 immersed in the toner 201 is surrounded by the compressed toner 201, and in some cases, toner particles aggregate to attach to the surface of the conveying sheet 213.

When the conveying sheet 213 is surrounded by the toner 201 in the compressed state, an extremely large load is to act on the conveying sheet 213. In other words, the conveying sheet 213 in the state of being immersed in the toner 201 is in the state where it is hard to displace.

In such a case, it is necessary to impart extremely large torque for the toner stirring section 203 in order to rotate the toner stirring section 203. That is, a load applied to the motor increases in order to rotate the tonner stirring section 203 in such a case.

When the load on the motor increases in this way, there is a possibility that the motor loses synchronism or is broken. Accordingly, in order to avoid such a failure, an existing main body of the image forming apparatus is mounted with a motor capable of generating large torque in advance.

However, the load on the motor increases most, in other words, the torque required for rotating the toner stirring section 203 increases most when rotating the toner stirring section 203 in the toner cartridge 200 in the initial state, and after the toner 201 in the compressed state is disintegrated with a rotation of the toner stirring section 203, torque needed for rotatable driving does not increase so much.

That is, the existing main body of the image forming apparatus is mounted with a motor capable of generating large torque only to avoid a failure generated for the toner cartridge 200 in the initial state. Accordingly, there is a problem that the existing main body of the image forming apparatus has an extremely uneconomical configuration.

Japanese Unexamined Patent Publication JP-A 2001-290350 discloses that a toner aggregate included in a toner contained in a casing of a toner replenishing apparatus is pulverized by a pulverizing member which is provided to stand on an inner wall of the casing and whose leading end is formed in a concavo-convex shape and an agitator for pulverizing the toner aggregate whose leading end is formed in a concavo-convex shape which fits the concavo-convex shape. However, in JP-A 2001-290350, there is no consideration as to a failure which is generated during the initial rotation as described above.

SUMMARY OF THE INVENTION

An object of the invention is to provide a toner cartridge capable of reducing torque required for rotating a toner stirring section for stirring and conveying a toner in the toner cartridge in an initial state and an image forming apparatus including the same.

The invention provides a toner cartridge comprising a casing which contains a toner; and a toner stirring section which is rotatably provided around a predetermined axis in the casing, stirs the toner contained in the casing to convey to a conveying destination, the toner stirring section including:

a first rotating body which is rotated around the axis and stirs the toner contained in the casing; and a second rotating body which is provided with a conveying sheet for conveying the toner to the conveying destination and is rotated around the axis by being pressed by the first rotating body which is rotated and conveys the toner contained in the casing to the conveying destination, the first rotating body being provided so as to press the second rotating body after rotating by a predetermined degree relative to the second rotating body.

Further, in the invention, it is preferable that the first rotating body and the second rotating body are configured to be capable of engaging with each other and an engaged state is released when torque which is imparted to rotate the toner stirring section in the engaged state is a predetermined value or more.

Further, in the invention, it is preferable that the first rotating body has a plurality of toner disintegrating blades which protrude in a direction departing from the axis and is provided along the axis at intervals, and in the engaged state, the second rotating body and the toner disintegrating blade are adjacent in a rotational direction around the axis.

Further, in the invention, it is preferable that the plurality of toner disintegrating blades include a plurality of first toner disintegrating blades which are provided adjacent to the second rotating body, and a plurality of second disintegrating blades which are provided departing from the second rotating body in the rotational direction in the engaged state.

Further, the invention provides an image forming apparatus comprising the toner cartridge mentioned above.

According to the invention, the toner stirring section includes the first rotating body configured so as to stir the toner in the casing, and the second rotating body configured to include a sheet-like conveying sheet for conveying the toner in the casing to an apparatus provided on a rear stage side such as a toner replenishing roller, and the first rotating body and the second rotating body are configured to be individually rotatable from each other. At this time, when the first rotating body is rotated by a driving force generating apparatus such as a motor which is mounted on a main body of the image forming apparatus, the second rotating body is pressed to be rotated by the first rotating body which is rotated. Further, the first rotating body is provided so as to press the second rotating body after rotating by a predetermined degree relative to the second rotating body.

Accordingly, it is possible to firstly rotate only the first rotating body without rotating the second rotating body provided with the conveying sheet in the toner cartridge in the initial state before being attached to the image forming apparatus, that is, in the toner cartridge in the state at the time of shipment when shipped as a product. This makes it possible to reduce torque required for rotating the toner stirring section, compared to the case of rotating the first rotating body and the conveying sheet integrally.

Additionally, before rotating the second rotating body provided with the conveying sheet, it is possible to disintegrate the toner in the compressed state with the rotation of the first rotating body. Therefore, even when the first rotating body presses and rotates the second rotating body, it is possible to reduce the torque required for rotating the toner stirring section. In this way, since the torque required for rotating the toner stirring section is able to be reduced, it is possible to effectively prevent the motor to rotate the toner stirring section from losing synchronism and being broken.

Further it is possible to reduce the torque required for rotating the toner stirring section so that it is possible to employ a miniature motor whose rated torque is small as a motor to be mounted on the main body of the image forming apparatus in order to rotate the toner stirring section. In other words, even when the motor whose rated torque is small is employed, it is possible to prevent the motor from losing synchronism or being broken. Therefore, it is possible to realize an economical image forming apparatus.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
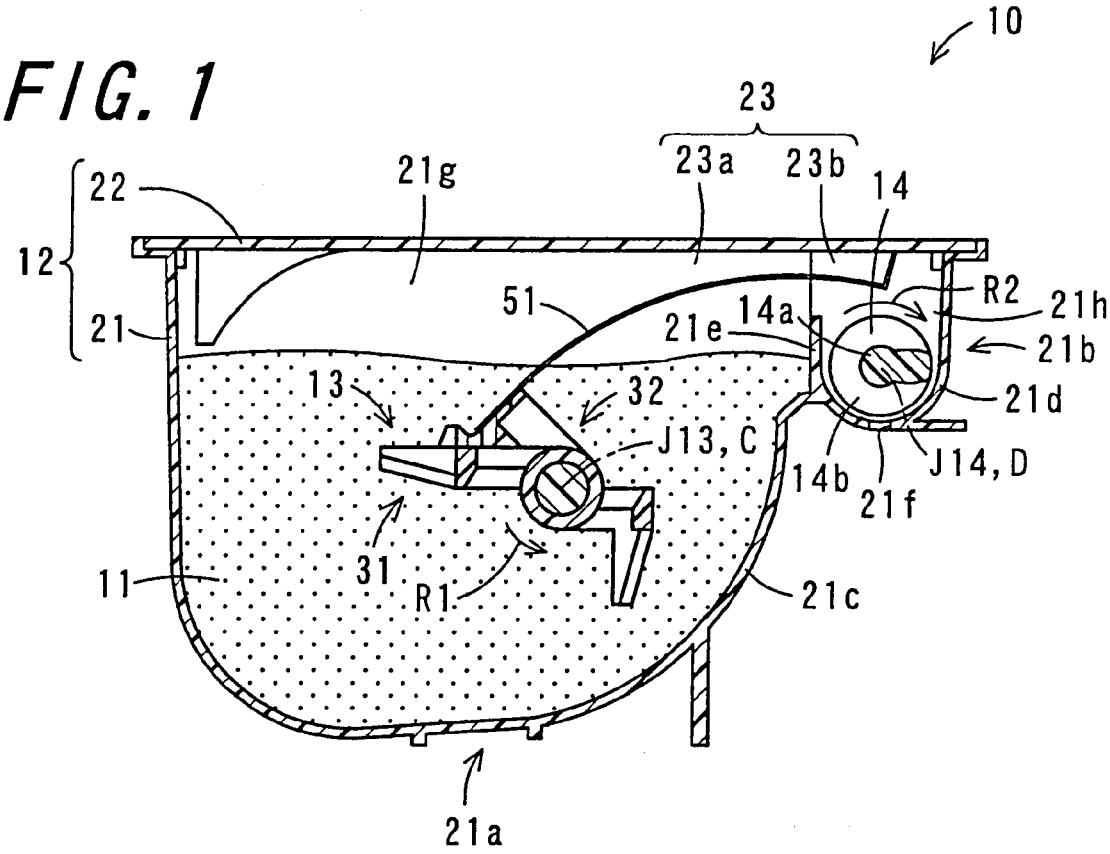
FIG. 1 is a cross-sectional view showing a toner cartridge according to an embodiment of the invention.

Now referring to the drawings, preferred embodiments of the invention are described below.

FIG. 1 is a cross-sectional view showing a toner cartridge 10 according to an embodiment of the invention. The toner cartridge 10 is detachably attached to a main body of an image forming apparatus with the use of an electrophotography such as a copier, a printer, and a facsimile. Therefore, an appearance shape and a size thereof are not particularly limited, and an appropriate design is made depending on the main body of the image forming apparatus to be attached.

The toner cartridge 10 shown in FIG. 1 is an unused toner cartridge before being attached to the main body of the image forming apparatus, that is, a toner cartridge when shipped as a product. Hereinafter, the toner cartridge 10 in a state shown in FIG. 1 is also referred to as a toner cartridge 10 in an initial state.

The toner cartridge 10 includes a casing 12, a toner stirring section 13 which stirs and conveys a toner 11 which is contained in the casing 12, and a toner replenishing roller 14 which supplies the toner 11 which has been conveyed by the toner stirring section 13 to a developing device which is mounted on the main body of the image forming apparatus, and is configured by assembling them, by being filled with an appropriate amount of the toner 11 and by being sealed off.

Specific description will hereinafter be given for each component constituting the toner cartridge 10.

The casing 12 includes a container main body 21 which opens upward, a plate-like lid body 22 for blocking an opening of the container main body, and is configured by joining them.

The container main body 21 includes a toner containing section 21*a* which contains the toner 11 and to which the toner stirring section 13 is attached, and a roller containing section 21*b* to which a toner replenishing roller 14 is attached, and is integrally formed by resin molding from an ABS (Acrylonitrile Butadiene Styrene) resin, for example.

The toner containing section 21*a*, specifically, is formed to be like a container having a rectangular opening with a body section 21*c* having an approximately semicylindrical shape and a pair of first side wall sections 21*g* which are flat and consecutively provided in the body section 21*c* so as to block approximately semicircular-shaped openings at both ends of the body section 21*c*. Further, specifically, the roller containing section 21*b* is formed to be like a container having a rectangular opening with a body section 21*d* having an approximately semicylindrical shape and a pair of second side wall sections 21*h* which are flat and consecutively provided in the body section 21*d* so as to block approximately semicircular-shaped openings at both ends of the body section 21*d*.

In the casing 12, the toner containing section 21*a* and the roller containing section 21*b* are disposed so that each of the body sections 21*c* and 21*d* extends to the same direction and each of the rectangular openings is adjacent to each other. The container main body 21 opening upward is thereby formed. At this time, an upward opening edge of the container main body 21 which is formed by the toner containing section 21*a* and the roller containing section 21*b* is a consecutive, flush and flat surface so as to make it easy to join the flat plate-like lid body 22.

The lid body 22 is the flat plate-like body formed into an outer shell-like shape which is approximately the same outline shape of the upward opening edge of the container main body 21, and is formed by resin molding from an ABS resin, for example. The lid body 22 is arranged so as to cover the upward opening edge of the container main body 21, and is joined to the container main body 21 so as to seal off the upward opening edge using an adhesive agent or the like, for example.

That is, in the casing 12 formed by joining the container main body 21 and the lid body 22, the toner 11 contained in the casing 12 is prevented from leaking out from the upward opening edge to the outside. Further, by joining the container main body 21 and the lid body 22, an internal space 23 is formed inside the casing 12.

The internal space 23 includes a toner containing space 23*a* which is formed by the toner containing section 21*a* and a roller containing space 23*b* which is formed by the roller containing section 21*b*. A wall section 21*e* which is a part of the body section 21*d* is arranged so as to face the toner containing space 23*a* and the roller containing space 23*b*. The wall section 21*e* is provided to stand toward the upward opening edge of the container main body 21. In the casing 12, the wall section 21*e* and the lid body 22 are arranged departing from each other. Each of the spaces 23*a* and 23*b* communicates with each other through a space between the lid body 22 and the wall section 21*e*. Therefore, the toner 11 which is contained in the toner containing section 21*a* is conveyed to the toner replenishing roller 14 which is attached to the roller containing section 21*b* through the space between the lid body 22 and the wall section 21*e*.

The toner stirring section 13 has a rotational axis C and is attached to the toner containing section 21*a* so as to rotate around the rotational axis C. The toner stirring section 13 is configured to be rotated around the rotational axis C, and thereby stir the toner 11 contained in the toner containing section 21*a* and convey the toner 11 to the toner replenishing roller 14 which is arranged in the rear stage side. That is, the toner stirring section 13 includes a configuration for stirring the toner 11 and a configuration for conveying the toner 11, and particularly includes a sheet-like conveying sheet 51 having flexibility as a configuration for conveying the toner 11. Conveyance of the toner 11 by the conveying sheet 51 is performed by that the conveying sheet 51 scoops a part of the toner 11 with a rotation around the rotational axis C of the toner stirring section 13, and supplies the scooped toner 11 to the toner replenishing roller 14.

The toner stirring section 13 according to the embodiment is configured by forming the first rotating body 31 including a configuration for stirring the toner 11 and the second rotating body 32 including the conveying sheet 51 for conveying the toner 11 as a separate body respectively and coupling the first rotating body 31 with the second rotating body 32. The specific configurations of the first rotating body 31 and the second rotating body 32 will be described below.

The toner stirring section 13 is disposed in the toner containing space 23*a* so that an axis J13 extending in parallel to a direction in which the body section 21*c* extends and the rotational axis C are matched. At this time, the toner stirring section 13 is rotatably supported by the pair of first side wall sections 21*g* of the toner containing section 21*a* around the axis J13.

The toner cartridge 10 is provided with a first gear (not shown) on an external surface part of one of the first side wall sections 21*g* in the toner containing section 21*a*. Specifically, the first gear is rotatably provided on the external surface part of the one of the first side wall 21*g* sections by matching the rotational axis and the axis J13. The toner stirring section 13 is configured to be coupled with the first gear and thereby be rotated in conjunction with a rotation of the first gear. On one end part in the direction of the rotational axis C in the toner stirring section 13, a coupling end section 44 which is coupled with the first gear (refer to FIG. 2) is provided, and accompanying with the rotation of the first gear, torque to rotate the toner stirring section 13 is imparted to the coupling end section 44.

A motor for rotating the toner stirring section 13 is mounted on the main body of the image forming apparatus to which the toner cartridge 10 is attached. In a state where the toner cartridge 10 is attached to the main body of the image forming apparatus, a driving force transferring mechanism stands between the motor and the first gear, and a rotation driving force of the motor is transferred to the first gear by the driving force transferring mechanism. The driving force transferring mechanism is realized by a plurality of gears, for example.

The toner stirring section 13, when attached to the main body of the image forming apparatus, has torque imparted through the driving force transferring mechanism and the first gear by the motor which is mounted on the main body of the image forming apparatus, and is rotated to a predetermined direction (direction of an arrow R1 in FIG. 1) by torque thereof. Then, the toner stirring section 13 is rotated in a rotational direction R1 so that the first rotating body 31 stirs the toner 11 which is contained in the toner containing section 21*a*, and the second rotating body 32 conveys the toner 11 which is contained in the toner containing section 21*a* to the toner replenishing roller 14.

The toner replenishing roller 14 is configured by a cylindrical shaft 14*a*, and a spiral blade 14*b* which is extendedly provided in a spiral manner on an outer circumferential surface of the shaft 14*a* from one direction to the other direction of the shaft 14*a*, and is integrally formed by resin molding from an ABS resin, for example.

The toner replenishing roller 14 is disposed in the roller containing space 23*b* so that a central axis D of the shaft 14*a* and an axis J14 extending parallel to the direction that the body section 21*d* extends are matched. At this time, the toner replenishing roller 14 is rotatably supported by a pair of the second side wall sections 21*h* of the roller containing section 21*b* around the axis J14. Note that, the axis J13 and the axis J14 are parallel to each other.

The toner cartridge 10 is provided with a second gear (not shown) on an external surface part of one of the second side wall sections 21*h* in the roller containing section 21*b*. Specifically, the second gear is rotatably provided on the external surface part of the one of the second side wall sections 21*h* by matching the rotational axis and the axis J14. The toner replenishing roller 14 is configured to be coupled with the second gear and thereby be rotated in conjunction with a rotation of the second gear. On one end part in the direction of the central axis D in the toner replenishing roller 14, a coupling end section (not shown) which is coupled with the second gear is provided, and accompanying with the rotation of the second gear, torque for rotating the toner replenishing roller 14 is imparted to the coupling end section.

A motor for rotating the toner replenishing roller 14 is mounted on the main body of the image forming apparatus to which the toner cartridge 10 is attached and may be a motor which is same as the motor for rotating the toner stirring section 13. In a state where the toner cartridge 10 is attached to the main body of the image forming apparatus, a driving force transferring mechanism stands between the motor and the second gear, and a rotation driving force of the motor is transferred to the second gear by the driving force transferring mechanism. The driving force transferring mechanism is realized by a plurality of gears, for example.

The toner replenishing roller 14, when attached to the main body of the image forming apparatus, has torque imparted through the driving force transferring mechanism and the second gear by the motor which is mounted on the main body of the image forming apparatus, and is rotated to a predetermined direction (direction of an arrow R2 in FIG. 1) by a torque thereof. Then, the toner replenishing roller 14 is rotated to a rotational direction R2 so that the toner 11 which has been conveyed to the roller containing space 23*b* by the toner stirring section 13 is conveyed from one direction to the other direction in the direction of the axis J14.

On the other side of the direction of the axis J14 in the body section 21*d* of the roller containing section 21*b*, a toner replenishing port 21*f* is formed so as to pierce through in the vertical direction. The toner replenishing port 21*f* discharges the toner 11 that has been conveyed by the toner replenishing roller 14 to the outside of the toner cartridge 10. That is, the toner 11 that has been conveyed by the toner replenishing roller 14 to the toner replenishing port 21*f* falls by gravity though the toner replenishing port 21*f* to be discharged to the outside of the toner cartridge 10.

Downward in the vertical direction of the toner replenishing port 21*f* in the toner cartridge 10 attached to the main body of the image forming apparatus, a developing device is arranged. In this case, the toner 11 contained in the toner cartridge 10 is supplied to the developing device through the toner replenishing port 21*f* by that the toner stirring section 13 and the toner replenishing roller 14 are rotated.

Hereinafter, specific description will be given respectively for the first rotating body 31 and the second rotating body 32 which constitute the toner stirring section 13.

Figure 2:
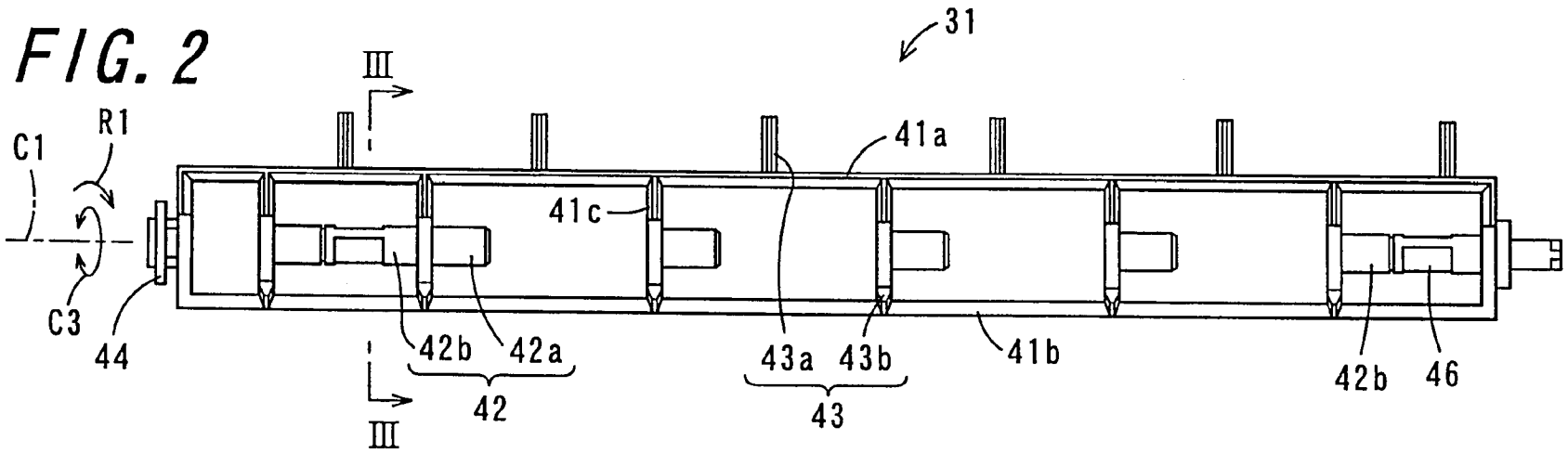
FIG. 2 is a plan view showing the first rotating body.
Figure 3:
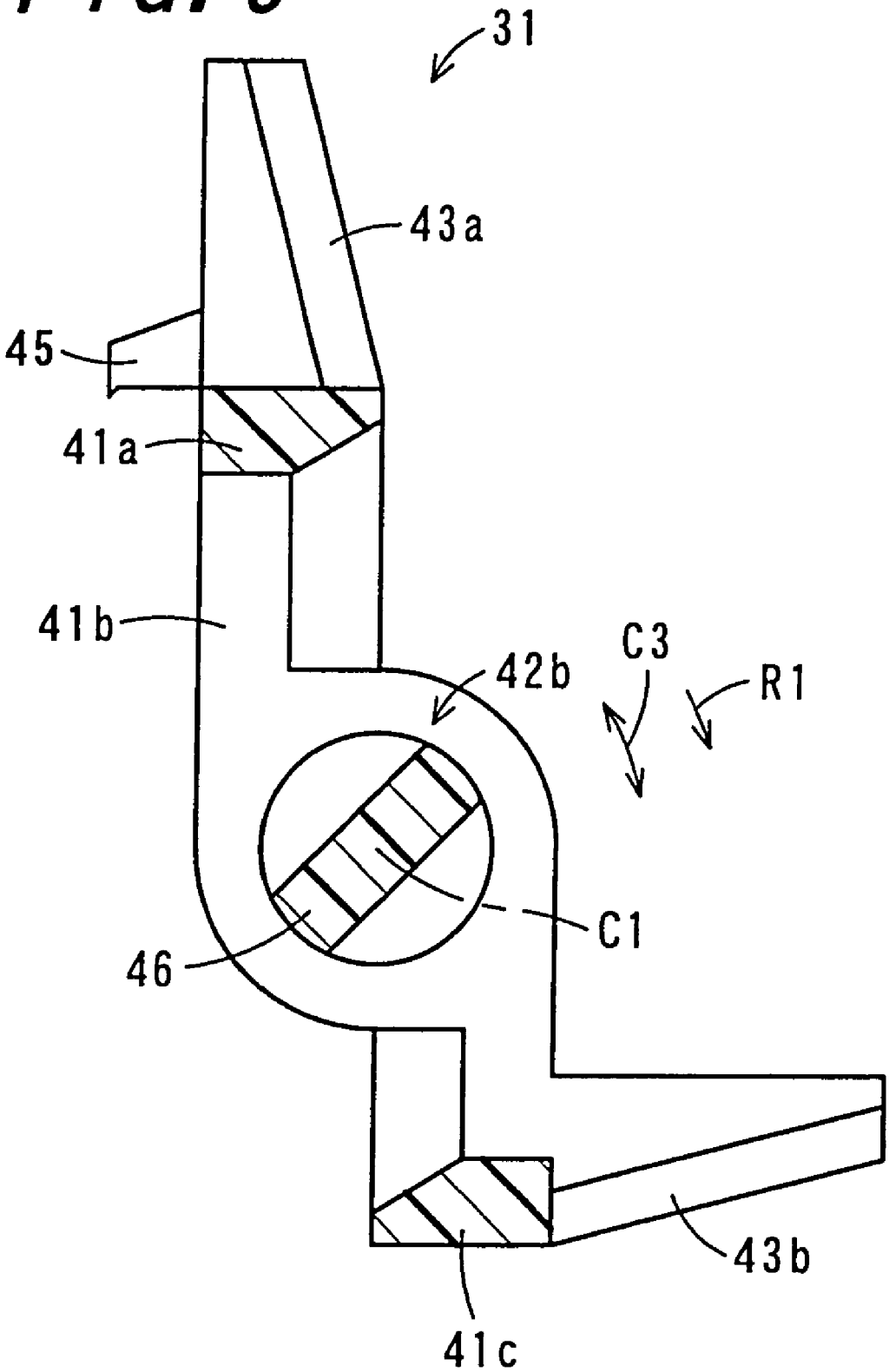
FIG. 3 is a cross-sectional view which is viewed along a cross-sectional line III-III of FIG. 2.
Figure 4:
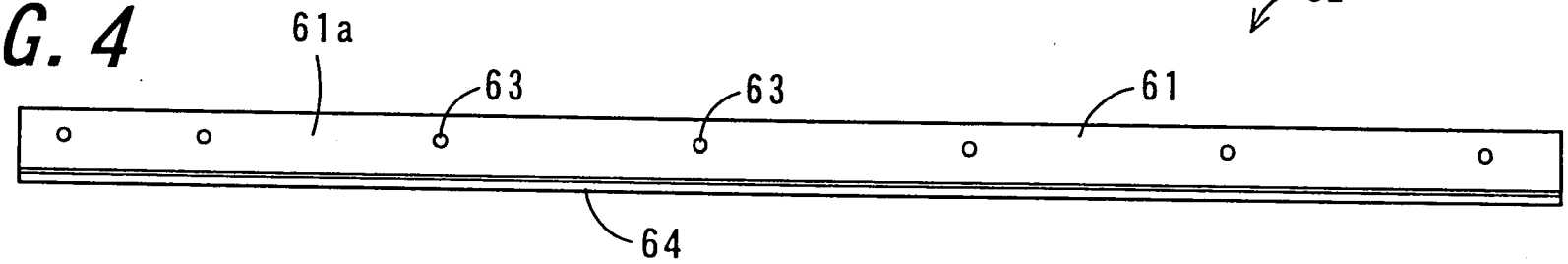
FIG. 4 is a plan view of a sheet supporting body of the second rotating body.
Figure 5:
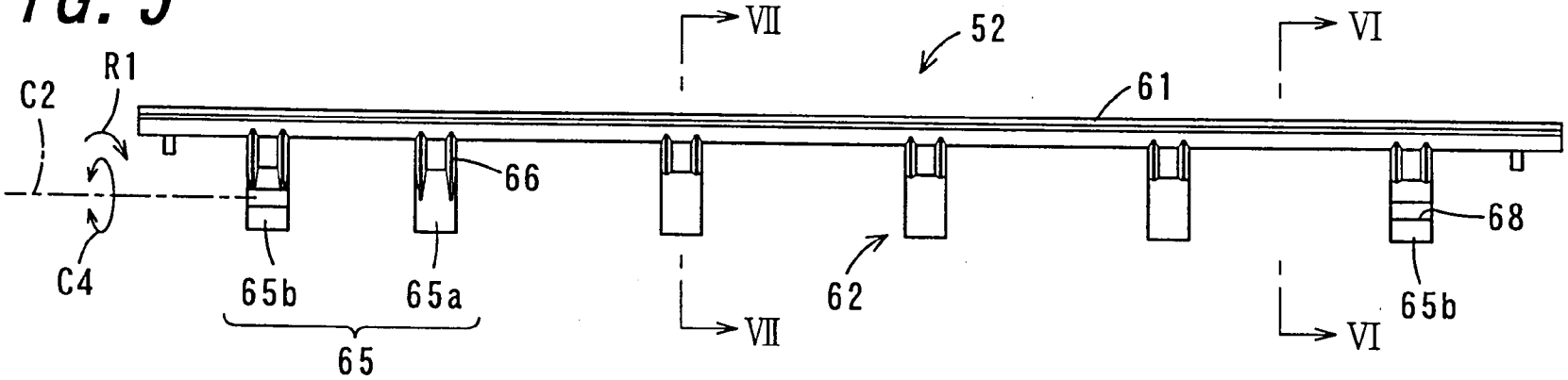
FIG. 5 is a front view of the sheet supporting body of the second rotating body.
Figure 6:
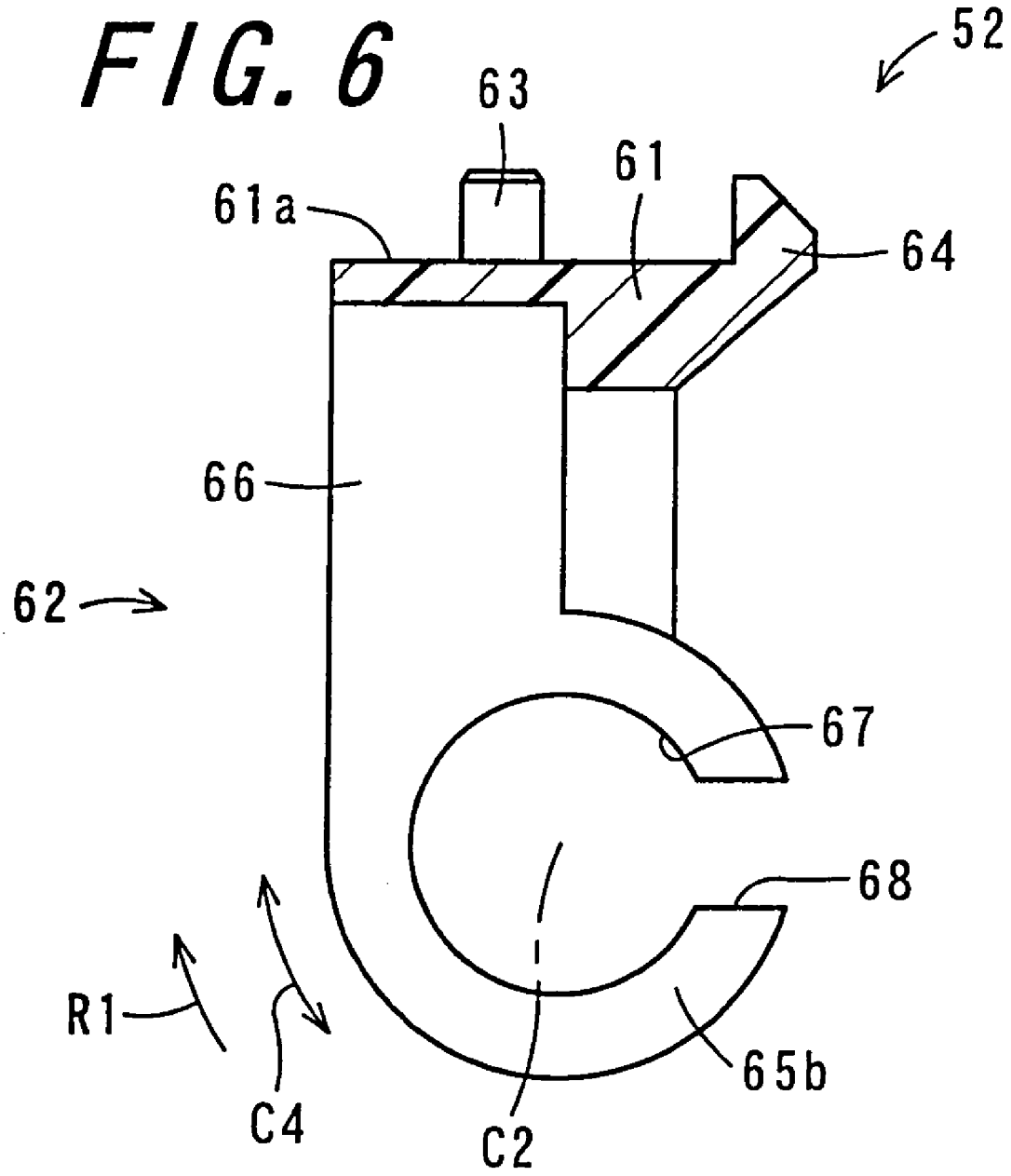
FIG. 6 is a cross-sectional view which is viewed along a cross-sectional line VI-VI of FIG. 5.
Figure 7:
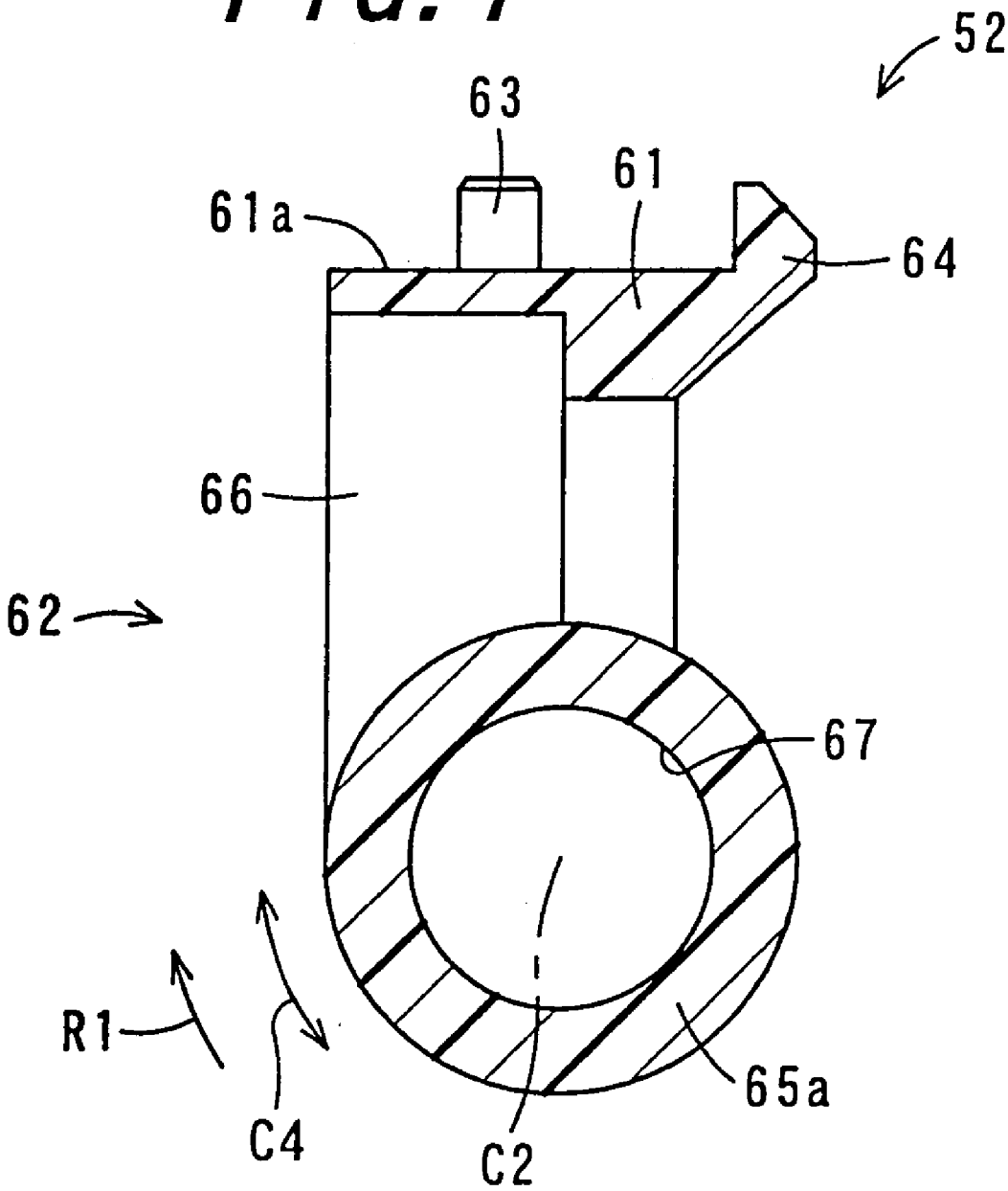
FIG. 7 is a cross-sectional view which is viewed along a cross-sectional line VII-VII of FIG. 5.
Figure 8:
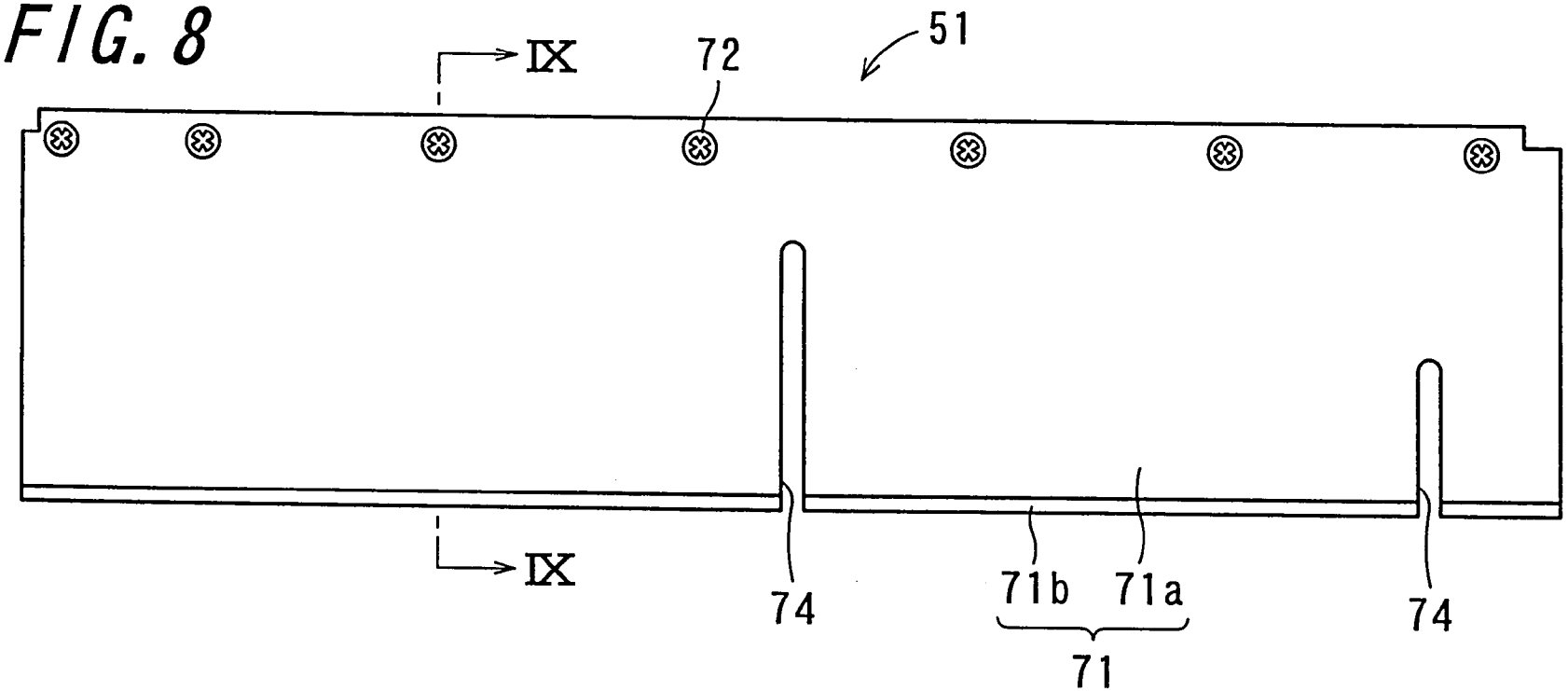
FIG. 8 is a plan view of a conveying sheet of the second rotating body.
Figure 9:
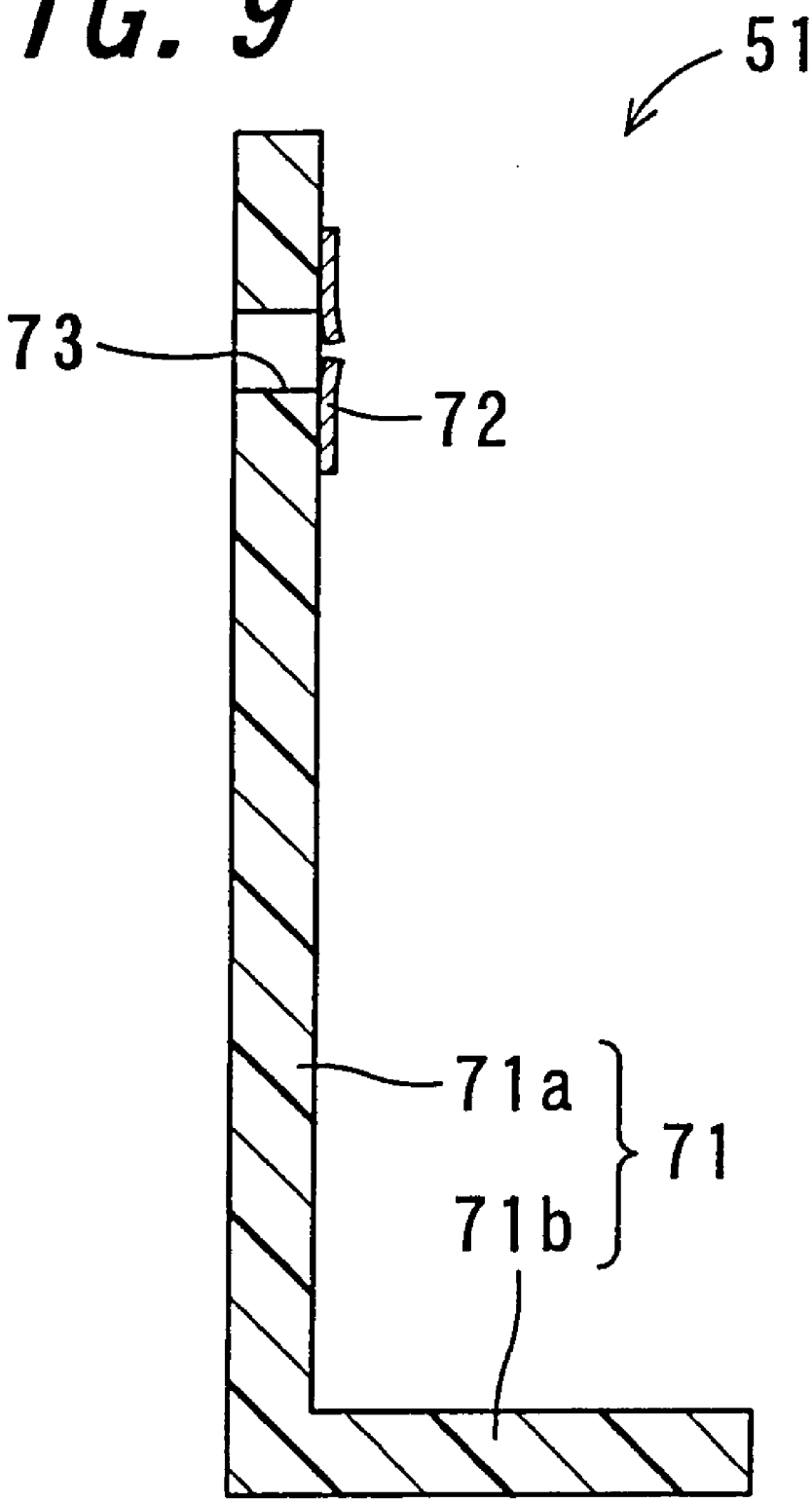
FIG. 9 is a cross-sectional view which is viewed along a cross-sectional line IX-IX of FIG. 8.

FIG. 2 is a plan view showing the first rotating body 31. FIG. 3 is a cross-sectional view which is viewed along a cross-sectional line III-III of FIG. 2. FIG. 4 is a plan view of a sheet supporting body 52 of the second rotating body 32. FIG. 5 is a front view of the sheet supporting body 52 of the second rotating body 32. FIG. 6 is a cross-sectional view which is viewed along a cross-sectional line VI-VI of FIG. 5. FIG. 7 is a cross-sectional view which is viewed along a cross-sectional line VII-VII of FIG. 5. FIG. 8 is a plan view of a conveying sheet 51 of the second rotating body 32. FIG. 9 is a cross-sectional view which is viewed along a cross-sectional line IX-IX of FIG. 8.

First, with reference to FIG. 2 and FIG. 3, specific description will be given for the first rotating body 31.

The first rotating body 31 is a member that extends along a rotational axis C1, and is integrally formed by resin molding from, for example, an ABS resin, a HIPS (High Impact Poly-Styrene) resin, or the like.

The first rotating body 31 includes a frame 41, a plurality of first coupling sections 42, a plurality of toner disintegrating blades 43 and a coupling end section 44. The frame 41 extends along the rotational axis C1 and is formed into a skeleton-shape. The plurality of first coupling sections 42 are provided on the frame 41. In the embodiment, 6 pieces of first coupling sections 42 are provided. The plurality of toner disintegrating blades 43 is provided on the frame 41 so as to protrude in a direction departing from the rotational axis C1. In the embodiment, 12 pieces of toner disintegrating blades 43 are provided. The coupling end section 44 is provided at one end part of the rotational axis C1 direction of the frame 41. The first rotating body 31 is so configured that the one end part and the other end part in the rotational axis C1 direction thereof are rotatably supported by the pair of first side wall section 21*g* of the toner containing section 21*a*. Note that, the rotational axis C1 of the first rotating body 31 corresponds to a rotational axis C of the toner stirring section 13. Hereinafter, a direction of circulating around the rotational axis C1 is referred to as a circumferential direction C3. At this time, one direction of the circumferential direction C3 is matched with a rotational direction R1 of the toner stirring section 13.

The frame 41 includes a column-like first supporting section 41*a*, a column-like second supporting section 41*b*, and a plurality of flat plate-like third supporting sections 41*c*. The column-like first supporting section 41*a* is provided parallel to the rotational axis C1 departing from the rotational axis C1 by a predetermined distance. The column-like second supporting section 41*b* is provided parallel to the rotational axis C1 departing from the rotational axis C1 by a predetermined distance and provided departing in the circumferential direction C3 by a predetermined angle with respect to the first supporting section 41*a*. The plurality of flat plate-like third supporting sections 41*c* are provided parallel to a virtual plane which is perpendicular to the rotational axis C1 and consecutively provided to the first supporting section 41*a* and the second supporting section 41*b*. In the embodiment, 8 pieces of third supporting section 41*c* are provided along the rotational axis C1 at predetermined intervals.

In the embodiment, the first supporting section 41*a* and the second supporting section 41*b* are provided departing in the circumferential direction C3 by approximately 180 degrees. However, the angle departing in the circumferential direction C3 is not limited thereto, and is able to be set as appropriate.

In the embodiment, in the first supporting section 41*a*, the second supporting section 41*b* and the third supporting section 41*c*, an end part on one direction side of the circumferential direction C3, specifically, an end part on the downstream side of the rotational direction R1 of the toner stirring section 13 is formed to be tapered toward the downstream side of the rotational direction R1.

Each first coupling section 42 is formed to be a right cylinder shape having a same outer diameter and provided to stand vertically to the third supporting section 41*c* so that the central axis thereof is matched with the rotational axis C1. The plurality of first coupling sections 42 include a protruding coupling section 42*a* and a shaft-like coupling section 42*b*. The protruding coupling section 42*a* protrudes toward one direction side of the rotational axis C1 direction from the third supporting section 44*c*. The shaft-like coupling section 42*b* extends over the third supporting section 41*c* which is adjacent thereto. In the embodiment, the plurality of first coupling sections 42 include 4 pieces of protruding coupling sections 42*a* and 2 pieces of shaft-like coupling sections 42*b*.

The shaft-like coupling section 42*b* has a flat-plate like notch section 46 formed by cutting out an outer circumferential part thereof so as to attach a C-shaped tubular section 65*b* of the second rotating body 32 which will be described below. Additionally, the protruding coupling section 42*a* is formed into a conical trapezoidal shape whose top part is tapered.

The toner disintegrating blade 43 is formed to be tapered toward a direction departing from the rotational axis C1, and furthermore, an end part on one direction side of the circumferential direction C3, specifically, an end part on the downstream side of the rotational direction R1 of the toner stirring section 13 is formed to be tapered toward the downstream side of the rotational direction R1.

The plurality of toner disintegrating blades 43 includes a first toner disintegrating blade 43*a* and a second toner disintegrating blade 43*b*. The first toner disintegrating blade 43*a* protrudes from a surface on a side opposite to the side on which the third supporting section 41*c* is provided in the first supporting section 41*a* toward a direction departing from the rotational axis C1. The second toner disintegrating blade 43*b* protrudes from a surface on a side opposite to the side on which a tapered end part is formed in the second supporting section 41*b* toward a direction departing from the rotational axis C1, specifically toward the upstream side of the rotational direction R1. In the embodiment, the plurality of toner disintegrating blades 43 include 6 pieces of first toner disintegrating blades 43*a* and 6 pieces of second toner disintegrating blades 43*b*.

The first toner disintegrating blade 43*a* is provided in a position which is approximately middle of the third supporting section 41*c* which is adjacent thereto in the rotational axis C1 direction. That is, the first toner disintegrating blades 43*a* are provided at appropriate intervals along the rotational axis C1. Furthermore, the second toner disintegrating blade 43*b* is provided so as to be matched with the position where the third supporting section 41*c* is provided in the rotational axis C1 direction. That is, the second toner disintegrating blades 43*b* are provided at appropriate intervals along the rotational axis C1. Since the first and second toner disintegrating blades 43*a* and 43*b* are arranged in this manner along the rotational axis C1 direction, the first toner disintegrating blades 43*a* and the second toner disintegrating blades 43*b* are provided along the rotational axis C1 alternately.

Moreover, in the first toner disintegrating blade 43*a*, at an end part on the other direction side of the circumferential direction C3, specifically, at an end part on the upstream side of the rotational direction R1 of the toner stirring section 13, an engaging claw 45 is provided in a protruding state. Each engaging claw 45 is formed to be capable of engaging with an engaging protrusion section 64 of the second rotating body 32 which will be described below.

The coupling end section 44 is provided at one end part of the rotational axis C1 direction of the frame 41 so that the central axis thereof and the rotational axis C1 are matched, and coupled with the first gear which has been described above. Therefore, with the rotation of the first gear, torque is imparted to the coupling end section 44.

Next, specific description will be given for the second rotating body 32.

The second rotating body 32 includes a conveying sheet 51 and a sheet supporting body 52. The conveying sheet 51 conveys a toner 11 contained in the toner containing section 21*a* to the toner replenishing roller 14. The sheet supporting body 52 supports the conveying sheet 51. The second rotating body 32 is configured by coupling the conveying sheet 51 with the sheet supporting body 52 to be fixed.

Hereinafter, with reference to FIGS. 4 to 7, specific description will be given for the sheet supporting body 52 of the second rotating body 32.

The sheet supporting body 52 is a member that extends along the rotational axis C2, and is integrally formed by resin molding from, for example, an ABS resin, a HIPS (High Impact PolyStyrene) resin, and the like.

The sheet supporting body 52 includes a flat plate-like sheet supporting table 61 and a plurality of second coupling sections 62. The flat plate-like sheet supporting table 61 is provided parallel to the rotational axis C2 departing from the rotational axis C2 by a predetermined distance. The plurality of second coupling sections 62 are provided to stand toward a direction moving closer to the rotational axis C2 from the sheet supporting table 61. In the embodiment, 6 pieces of second coupling sections 62 are provided, and are provided at predetermined intervals along the rotational axis C2. Note that, the rotational axis C2 of the second rotating body 32 corresponds to the rotational axis C of the toner stirring section 13. Hereinafter, a direction of circulating around the rotational axis C2 is referred to as a circumferential direction C4. At this time, one direction of the circumferential direction C4 is matched with the rotational direction R1 of the toner stirring section 13.

In the sheet supporting table 61, a flat sheet supporting surface 61*a* is formed on a side opposite to the side on which the second coupling section 62 is provided. Further, on the sheet supporting surface 61*a*, a plurality (7 pieces in the embodiment) of cylindrical protrusion 63 are provided to stand vertically at predetermined intervals along the rotational axis C2. Furthermore, in the sheet supporting table 61, on an end part of one direction of the circumferential direction C4, specifically, an end part on the downstream side of the rotational direction R1 of the toner stirring section 13, the engaging protrusion section 64 which is capable of engaging with each engaging claw 45 which is provided in the first rotating body 31 is formed along the rotational axis C2.

The second coupling section 62 has a tubular section 65 and a supporting section 66. A right-cylinder shape through hole 67 is formed in the tubular section 65. The supporting section 66 couples the tubular section 65 with the sheet supporting table 61. Each tubular section 65 of the plurality of second coupling sections 62 is formed to have a same inner diameter and arranged so that the central axis of the through hole 67 is matched with the rotational axis C2. Moreover, each tubular section 65 is formed so that the inner diameter thereof is slightly larger than the outer diameter of the first coupling section 42, and the length of the rotational axis C2 direction is formed to be shorter than the length of the rotational axis C1 direction of the protruding coupling section 42*a*.

Furthermore, the plurality of tubular sections 65 include a first cylindrical tubular section 65*a* and a second tubular section 65*b* In the first cylindrical tubular section 65*a*, the shape of a cross-section cut with a plane perpendicular to the central axis of the through hole 67 is a circular ring. In the second tubular section 65*b*, the shape of a cross-section cut with a plane perpendicular to the central axis of the through hole 67 is a C-shape (that is, a shape which a part of a circular ring is cut out). In the embodiment, the plurality of tubular sections 65 include 4 pieces of first tubular sections 65*a* and 2 pieces of second tubular sections 65*b*.

The first tubular section 65*a* is coupled to the protruding coupling section 42*a*, and the second tubular section 65*b* is coupled to a shaft-like coupling section 42*b*. Thus the first tubular section 65*a* and the second tubular section 65*b* are arranged to correspond to the arrangement of the protruding coupling section 42*a* and the shaft-like coupling section 42*b*.

In the second tubular section 65*b*, an opening section 68 that communicates with the through hole 67 and an external space along the radial direction thereof is formed. The opening section 68 is formed into a shape and a size that the flat plate-like notch section 46 of the first shaft-like coupling section 42*b* is able to be inserted into the through hole 67.

Hereinafter, with reference to FIGS. 8 and 9, specific description will be given for the conveying sheet 51 of the second rotating body 32.

The conveying sheet 51 is configured by a sheet body 71 having flexibility, and an insertion coupling member 72. The insertion coupling member 72 is configured by forming a through hole that penetrates into its thickness direction so as to prevent displacement of the member inserted to the through hole. The sheet body 71 is realized by, for example, PET (Polyethylene Terephthalate) or the like. Additionally, the insertion coupling member 72 is realized by a speed nut, a push nut, or the like.

Specifically, the conveying sheet 51 is configured by bending a rim section 71*b* on one direction side of the short side direction of an approximately rectangular sheet body 71 to a remained part 71*a* to a right angle or an approximately right angle, forming a plurality (7 pieces in the embodiment) of through holes 73 which penetrate into the thickness direction in the vicinity of the end part on the other direction side of the short side direction at predetermined intervals along the long side direction, and further, fixing the insertion coupling member 72 to the surface on the one direction side of the thickness direction of the sheet body 71, specifically the surface of the side facing the rim section 71*b* so as to cover each through hole 73. That is, as shown in FIG. 9, the conveying sheet 51 is formed to have a cross-sectional shape of an L-shape. Moreover, the intervals provided between the through holes 73 are matched with the intervals between protrusions 63 provided on the sheet supporting surface 61*a* of the sheet supporting body 52. Furthermore, on the conveying sheet 51, a notch 74 which extends from one direction side of the short side direction to the other direction side is formed at an approximately center part of the long side direction and in the vicinity of one end part of the long side direction.

The second rotating body 32 is configured by inserting the protrusions 63 of the sheet supporting body 52 into the through holes 73 of the conveying sheet 51 and the through holes of the insertion coupling member 72 respectively so that the conveying sheet 51 and the sheet supporting body 52 are coupled. At this time, the conveying sheet 51 is fixed to the protrusions 63 of the sheet supporting table 61 by the insertion coupling member 72.

Figure 10:
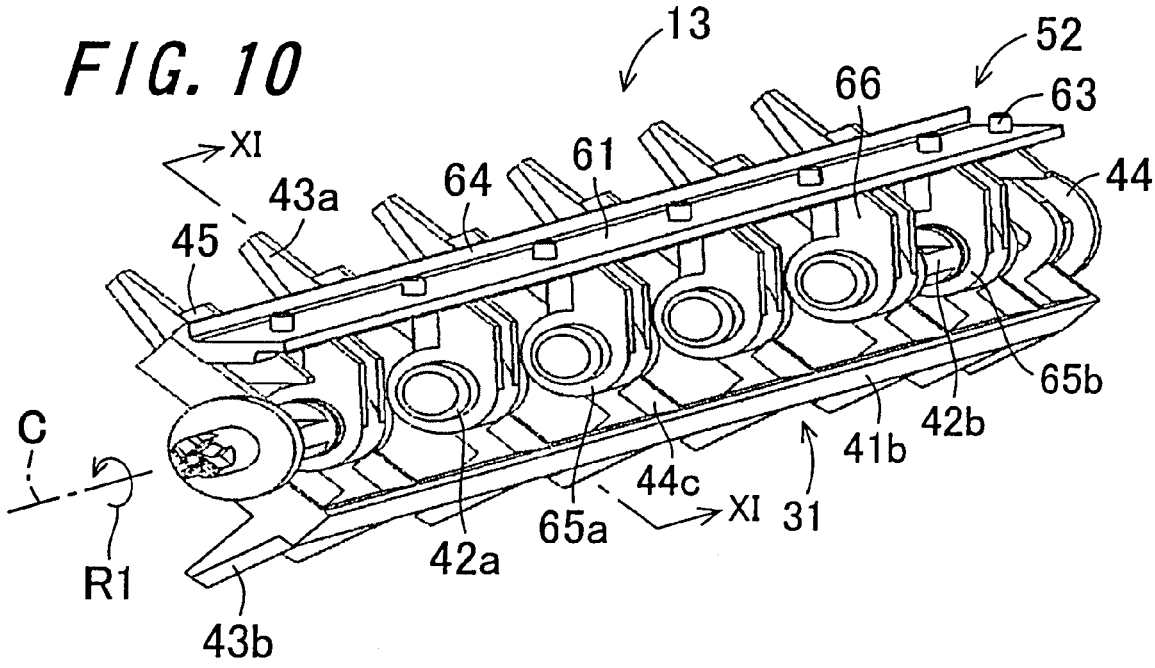
FIG. 10 is a perspective view showing the toner stirring section in an engaged state.
Figure 11:
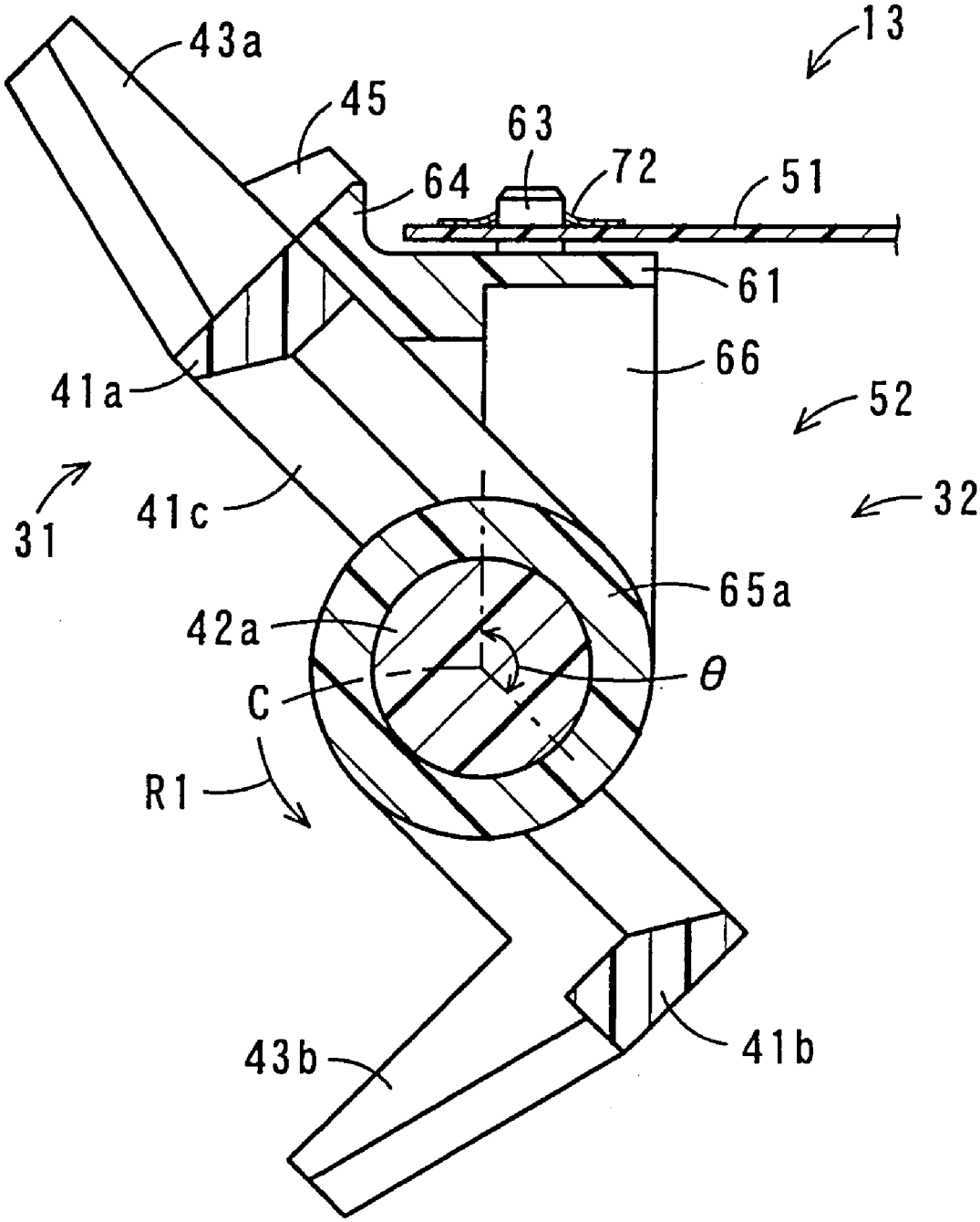
FIG. 11 is a cross-sectional view which is viewed along the cross-sectional line XI-XI of FIG. 10.

FIG. 10 is a perspective view showing the toner stirring section 13 in an engaged state. FIG. 11 is a cross-sectional view which is viewed along the cross-sectional line XI-XI of FIG. 10. Note that, FIG. 10 is shown with the conveying sheet 51 omitted.

The toner stirring section 13 is configured by coupling the first rotating body 31 and the second rotating body 32. Specifically, the notch section 46 formed on the protruding coupling section 42*a* of the first rotating body 31 is inserted into the through hole 67 formed into the second tubular section 65*b* so that the rotational axis C1 and the rotational axis C2 are matched through the opening section 68 of the second tubular section 65*b*, and thereafter the second rotating body 32 is displaced to the rotational axis C direction with respect to the first rotating body 31, and thus each first coupling section 42 of the first rotating body 31 is inserted so that the first rotating body 31 and the second rotating body 32 are coupled with respect to the through hole 67 formed on each tubular section 65 of the second rotating body 32.

At this time, as described above, since the inner diameter of the tubular section 65 is slightly larger than the outer diameter of the first coupling section 42, in a non-engaged state in which the second rotating body 32 is not engaged by the first rotating body 31, the second rotating body 32 is rotated freely around the rotational axis C with respect to the first rotating body 31.

In the embodiment, as described above, on the first toner disintegrating blade 43*a* of the first rotating body 31, an engaging claw 45 is provided in a protruding state at an end part on the upstream side of the rotational direction R1 of the toner stirring section 13, and on the sheet supporting table 61 of the second rotating body 32, an engaging protrusion section 64 is formed at an end part on the downstream side of the rotational direction R1 of the toner stirring section 13, and the engaging claw 45 and the engaging protrusion section 64 are configured so as to be capable of engaging with each other. Therefore, after coupling the first rotating body 31 and the second rotating body 32 as described above, the first rotating body 31 or the second rotating body 32 is rotated around the rotational axis C into the direction which the engaging claw 45 and the engaging protrusion section 64 are moving closer, so that the second rotating body 32 is able to be engaged with the first rotating body 31. That is, in the engaged state where the first rotating body 31 and the second rotating body 32 are engaged with each other, the first rotating body 31 and the second rotating body 32 are configured so as to be integrally rotated around the rotational axis C.

Moreover, the engaging claw 45 and the engaging protrusion section 64 are configured so that in the toner stirring section 13 in the engaged state, in the case where the torque imparted to rotate the toner stirring section 13 is a predetermined value or more, the engaged state is released. That is, the configuration is such that, in the toner stirring section 13 in the engaged state, the second rotating body 32 is fixed so as not to rotate around the rotational axis C, and in the case where the torque is imparted to the coupling end part 44 of the first rotating body 31 so that the toner stirring section 13 rotates in the rotational direction R1, when the torque imparted to the coupling end part 44 is a predetermined value or more, the engaging claw 45 comes off the engaging protrusion section 64. In the case of the embodiment, the predetermined value is able to be set to be a desirable value by appropriately designing the size of a part where the engaging claw 45 and the engaging protrusion section 64 are engaged.

Figure 12:
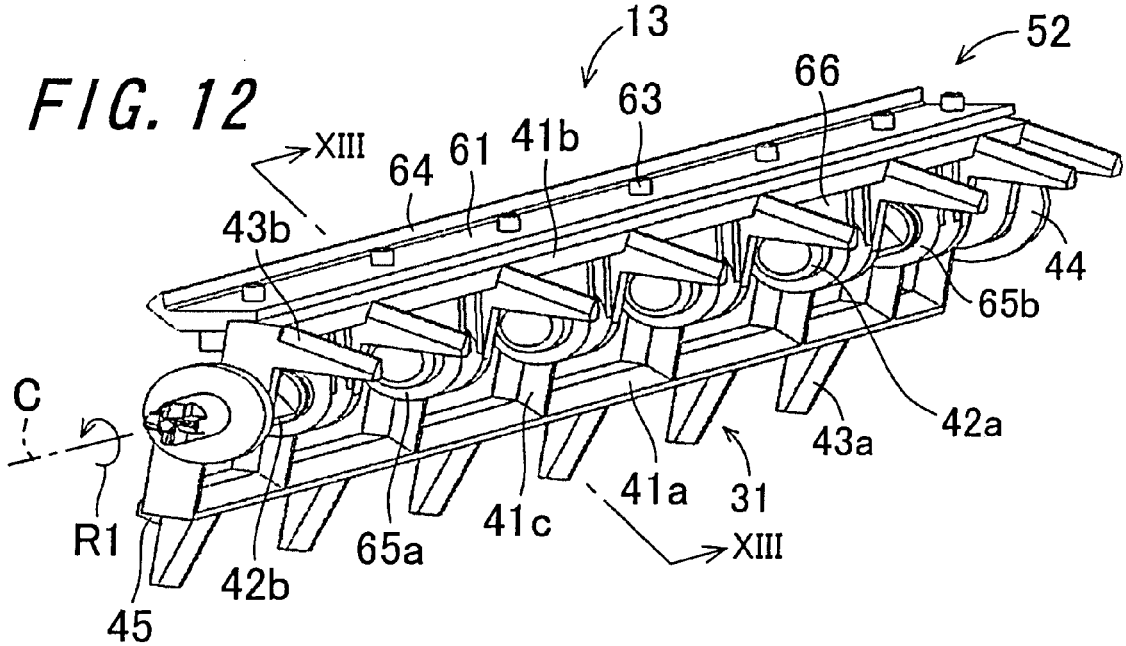
FIG. 12 is a perspective view showing the toner stirring section in a state where the first rotating body presses the second rotating body.
Figure 13:
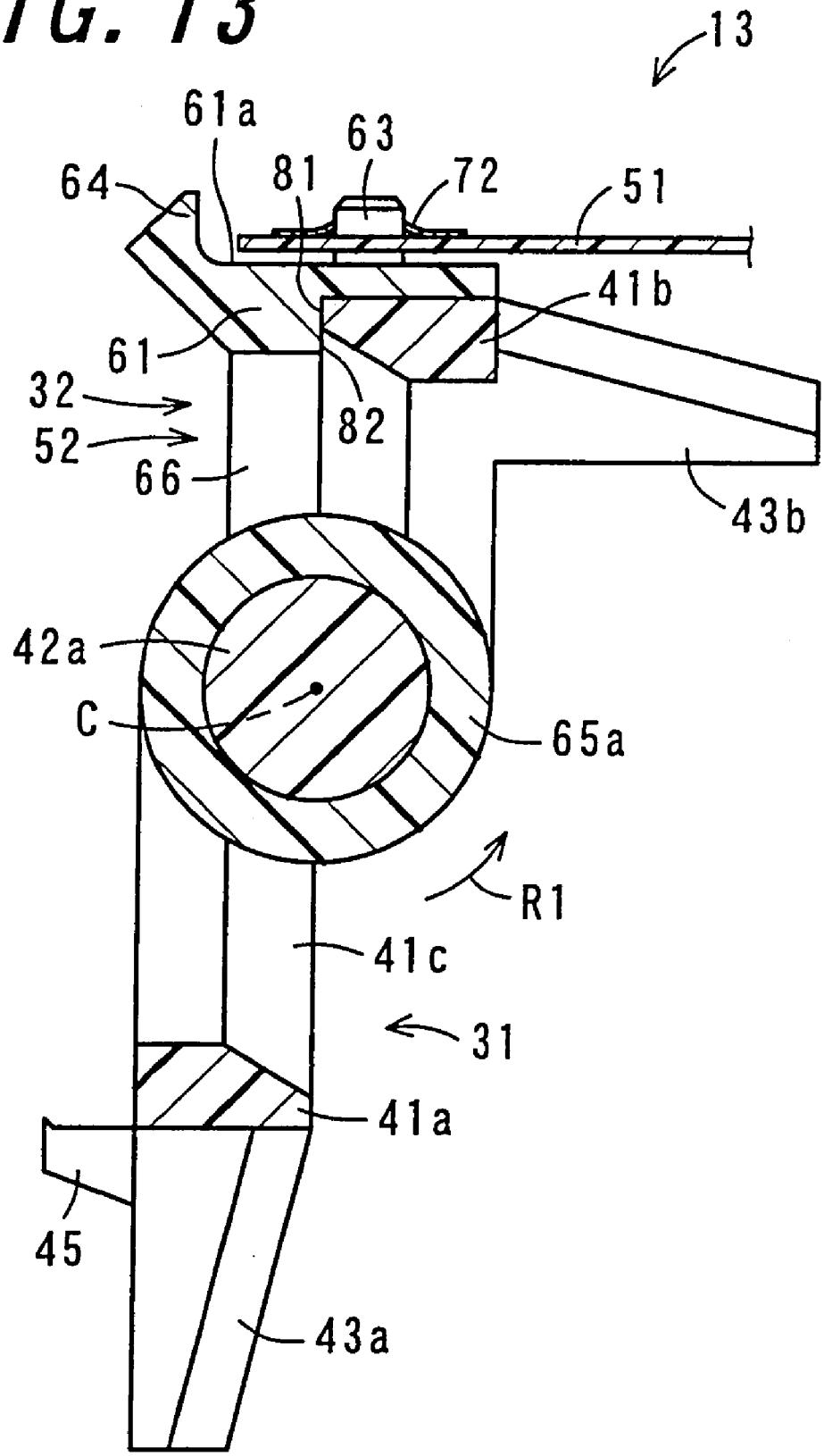
FIG. 13 is a cross-sectional view which is viewed along a cross-sectional line XIII-XIII of FIG. 12.

FIG. 12 is a perspective view showing the toner stirring section 13 in a state where the first rotating body 31 presses the second rotating body 32. FIG. 13 is a cross-sectional view which is viewed along a cross-sectional line XIII-XIII of FIG. 12. Note that FIG. 12 is shown with the conveying sheet 51 omitted.

In the toner stirring section 13, the second rotating body 32 is not so configured that the torque is directly imparted by the first gear, and further, in the non-engaged state, rotated freely around the rotational axis C with respect to the first rotating body 31. Therefore, as shown in FIG. 12 and FIG. 13, the toner stirring section 13 is configured to be capable of pressing the second rotating body 32 by the first rotating body 31 with the rotation of the first rotating body 31 so as to rotate the second rotating body 32 in the non-engaged state.

Specifically, the first rotating body 31 and the second rotating body 32 are so configured that the first rotating body 31 or the second rotating body 32 is rotated around the rotational axis C in the direction where the engaging claw 45 and the engaging protrusion 64 are departing therefrom, an end surface 81 on the end part on the downstream side of the rotational direction R1 in the second supporting section 41*b* is in surface-contact with a stepped face 82 formed on the surface on a side opposite to that of the sheet supporting surface 61*a* on the sheet supporting table 61.

Therefore, in the non-engaged state where the second rotating body 32 is rotated freely to the first rotating body 31, with respect to the first rotating body 31 rotated into the rotational direction R1, the second rotating body 32 is rotated into the rotational direction R1 around the rotational axis C as the torque is imparted by pressing the stepped face 82 with the end surface 81 of the first rotating body 31 which is rotated.

The toner stirring section 13 in the state of being pressed as shown in FIG. 13 is realized by rotating the first rotating body 31 in the rotational direction R1 by an angle θ relative to the second rotating body 32 from the stirring section 13 in the engaged state as shown in FIG. 11. The rotational angle θ is an angle formed between the end surface 81 and the stepped face 82, and is able to be easily changed by changing the angle by which the first supporting section 41*a* and the second supporting section 41*b* are departing in the circumferential direction C3.

FIGS. 14A to 14D are enlarged cross-sectional views showing a part of the image forming apparatus 100 to which the toner cartridge 10 is attached. Note that, FIGS. 14A to 14D are shown with the toner 11 omitted. In addition, the entire configuration of the image forming apparatus 100 including the stirring roller 101*a*, the developing roller 101*b* and the photoreceptor drum 102 will be described below.

Figure 14A:
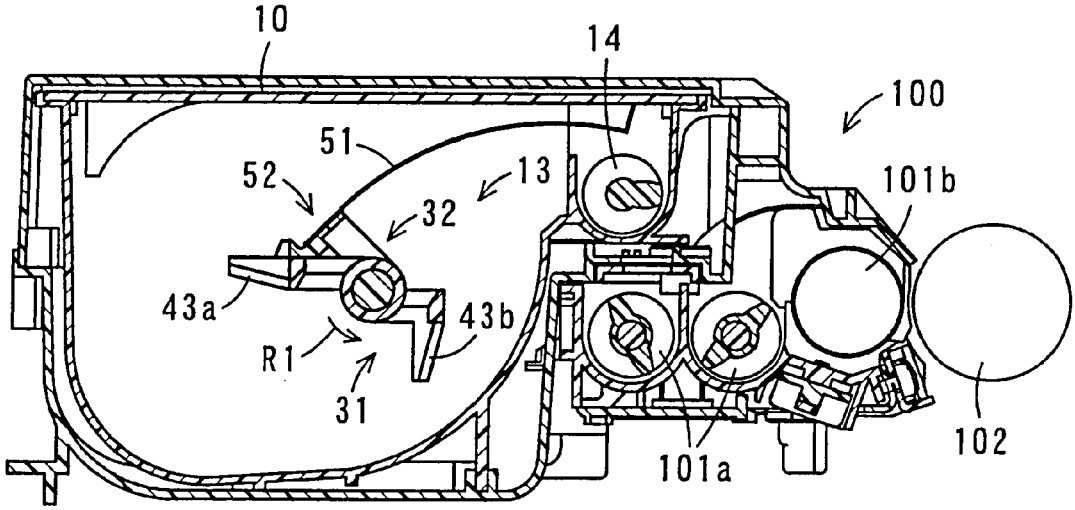
FIGS. 14A to 14D are enlarged cross-sectional views showing a part of the image forming apparatus to which the toner cartridge is attached.

FIG. 14A shows the toner cartridge 10 in an initial state. In the toner cartridge 10 in the initial state, the first rotating body 31 and the second rotating body 32 are engaged with each other. That is, the toner stirring section 13 in the engaged state is attached and further, in the toner containing section 21*a*, a large amount of toner 11 is contained. Thereby, a part of the toner stirring section 13 is in a state of immersed in the toner 11.

Figure 14B:
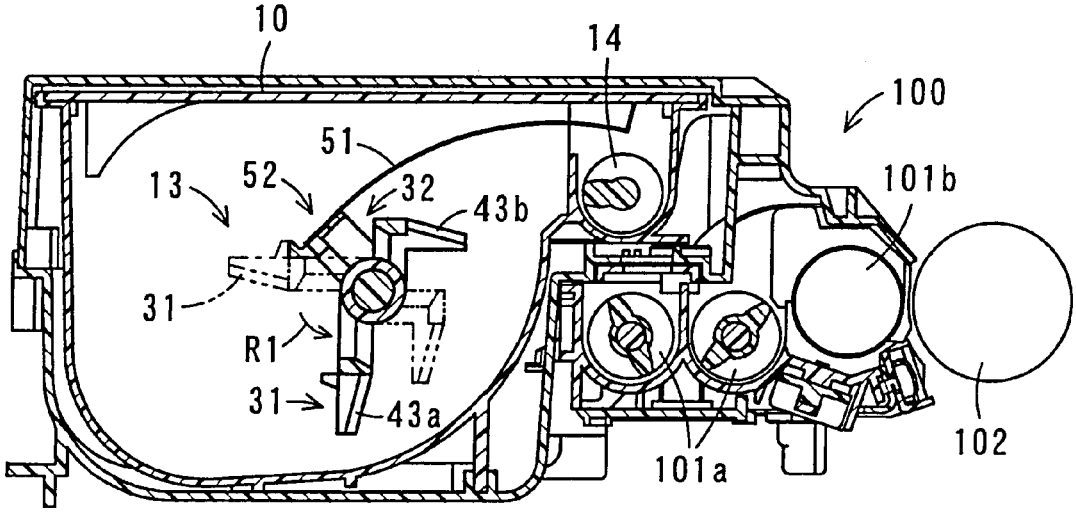

FIG. 14B shows the toner cartridge 10 in a state where the first rotating body 31 rotates alone. In the toner cartridge 10 in the initial state, when the torque imparted to the toner stirring section 13 is a predetermined value or more, the engaged state of the first rotating body 31 and the second rotating body 32 is released, and only the first rotating body 31 is rotated.

Figure 14C:
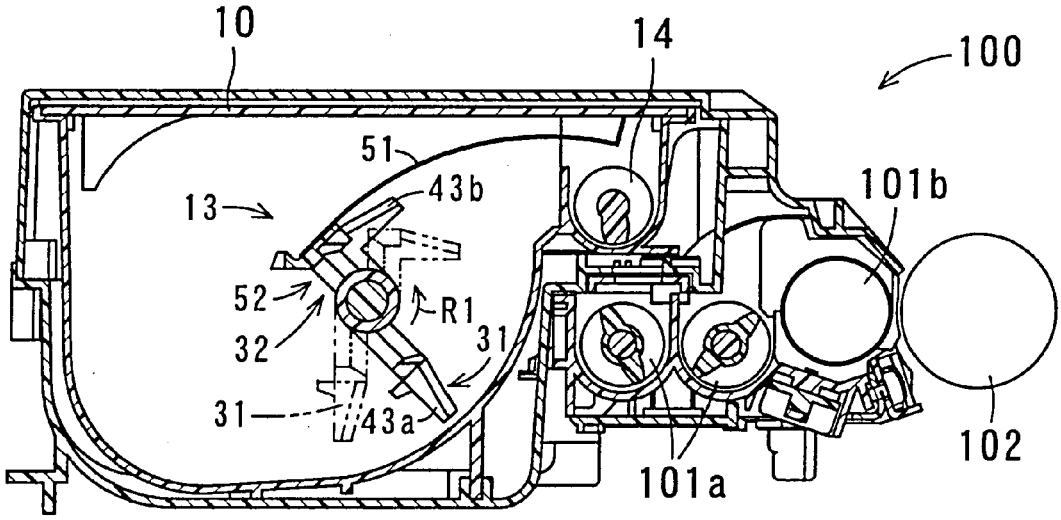

FIG. 14C shows the toner cartridge 10 when the end surface 81 of the first rotating body 31 contacts the stepped face 82 of the second rotating body 32. After the engaged state of the first rotating body 31 and the second rotating body 32 is released, the first rotating body 31 is rotated alone by a predetermined angle θ, and thereafter starts to press the second rotating body 32.

Figure 14D:
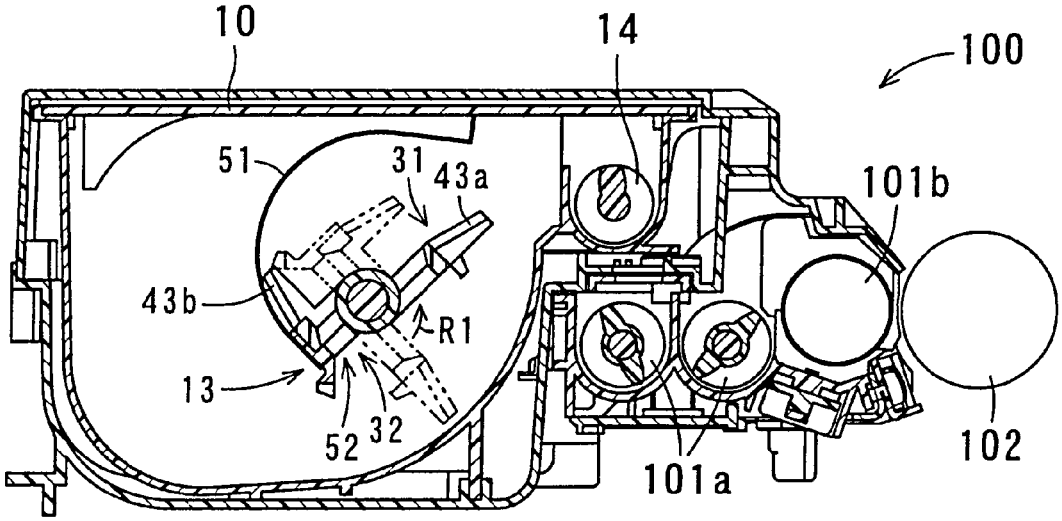

FIG. 14D shows the toner cartridge 10 in a state where the second rotating body 32 is pressed by the first rotating body 31 to rotate. In the toner stirring section 13 according to the embodiment, the first rotating body 31 and the second rotating body 32 are integrally rotated by pressing the second rotating body 32 with the first rotating body 31. With the rotation of the first rotating body 31 and the second rotating body 32, the toner 11 in the toner containing section 21*a* is stirred and disintegrated, and further, the toner 11 in the toner containing section 21*a* is conveyed to the toner replenishing roller 14.

The toner stirring section 13 in the toner cartridge 10 according to the embodiment, as described above, has the first rotating body 31 for stirring the toner 11 and the second rotating body 32 for conveying the toner 11, which are formed as separated bodies, and is further configured so that the second rotating body 32 is rotated freely for the first rotating body 31 in a coupling state of the first rotating body 31 and the second rotating body 32 so as to be capable of rotating the first rotating body 31 prior to the rotation of the second rotating body 32.

When the toner stirring section 13 configured in this manner is attached to a casing 12, in the state where the second rotating body 32 is rotated freely for the first rotating body 31, it is not easy to arrange the first rotating body 31 and the second rotating body 32 in predetermined positions, that is, departing the edge face 81 of the first rotating body 31 and the stepped face 82 of the second rotating body 32 by the predetermined angle θ in the rotational direction R1. However, the toner stirring section 13 according to the embodiment, as described above, is configured so that the first rotating body 31 and the second rotating body 32 are capable of engaging with each other. Accordingly, the first rotating body 31 and the second rotating body 32 are in an engaged state so that it is possible to easily arrange the first rotating body 31 and the second rotating body 32 in the predetermined positions.

Further, the toner stirring section 13 is configured so that when torque imparted to the toner stirring section 13 becomes a predetermined value or more in the engaged state, the engaged state is released to be in the non-engaged state. Therefore, even in the case of engaging the first rotating body 31 and the second rotating body 32 for arranging easily, when the torque imparted to the toner stirring section 13 becomes the predetermined value or more, the engaged state is released so that it is possible to rotate only the first rotating body 31. This makes it possible to prevent torque required for rotating the toner stirring section 13 from rising.

Additionally, when the torque imparted to the toner stirring section 13 becomes the predetermined value or more, since it is possible to rotate the first rotating body 31 for stirring the toner 11 prior to the rotation of the second rotating body 32 provided with the conveying sheet 51, it is possible to disintegrate the toner 11 and a toner agglomerate in a compressed state before the second rotating body 32 is rotated. This makes it possible to fluidize the toner 11 surrounding the conveying sheet 51 in the compressed state, and to reduce resistance against the rotation of the second rotating body 32.

Further, the engaged state of the toner stirring section 13 is able to be realized by providing the engaging claw 45 in the first rotating body 31 as well as providing the engaging protrusion section 64 in the second rotating body 32, which are engaged. In this way, a simple configuration makes it possible to realize the engaged state, which is economical.

Further, for the first toner disintegrating blade 43*a* of the first rotating body 31, the engaging claw 45 is provided in a protruding state at an edge part on an upstream side in the rotational direction R1 of the toner stirring section 13, the engaging protrusion section 64 is formed at an edge part on a downstream side in the rotational direction R1 of the toner stirring section 13 in the sheet supporting table 61 of the second rotating body 32, and thereby, in the engaged state of the toner stirring section 13, the first toner disintegrating blade 43*a* of the first rotating body 31 is able to be arranged adjacent to the sheet supporting table 61 of the second rotating body 32 along the rotational direction R1, more specifically, the first toner disintegrating blade 43*a* is able to be arranged on the downstream side of the sheet supporting table 61 in the rotational direction R1 and adjacent to the sheet supporting table 61. This makes it possible to effectively disintegrate the toner 11 and the toner agglomerate in the compressed state that are present on the downstream side in the rotational direction R1 of the second rotating body 32 with the first toner disintegrating blade 43*a*.

Further, the toner disintegrating blade 43, in the engaged state of the toner stirring section 13, includes the first toner disintegrating blade 43*a* adjacent to the sheet supporting table 61 and the second toner disintegrating blade 43*b* departing from the first toner disintegrating blade 43*a* in a circumferential direction so that it is possible to stir and disintegrate the toner 11 effectively along with the rotation of the first rotating body 31. Moreover, a plurality of first toner disintegrating blades 43*a* and a plurality of second toner disintegrating blades 43*b* are departed at predetermined intervals respectively in the rotational axis C direction, additionally, the first toner disintegrating blades 43*a* and the second toner disintegrating blades 43*b* are arranged alternately along the rotational axis C direction, and it is thus possible to stir and disintegrate the toner 11 more effectively along with the rotation of the first rotating body 31.

Further, on the conveying sheet 51, a notch 74 extending from an edge part on the side opposite to the edge part being fixed to the conveying sheet 51 toward an edge part on the side being fixed thereto is formed so that it is possible to reduce resistance against the rotation of the second rotating body 32. Additionally, when the toner cartridge 10 is kept in the vertical position, that is, in a position so that the axis J13 is parallel to the vertical direction, the toner 11 and the toner agglomerate in the compressed state are generated on one direction side in the axis J13 direction, and therefore, a plurality of the notch 74, when being formed on the conveying sheet 51, are preferably formed so that intervals between where the notches 74 are formed narrow as heading to both edge parts in a long side direction of the conveying sheet 51. Similarly, as to the toner disintegrating blade 43, the toner disintegrating blade 43 is also preferably provided so that intervals between where the toner disintegrating blade 43 is provided narrow as heading to both edge parts in the rotational axis C direction. Such a configuration makes it possible to reduce the resistance against the rotation of the second rotating body 32 effectively even in the case where the toner cartridge 10 is kept in the vertical position.

As explained above, the toner cartridge 10 according to the embodiment, in the initial state, is able to rotate only the first rotating body 31 first without rotating the conveying sheet 51. This makes it possible to reduce the torque required for rotating the toner stirring section 13, compared to the case of rotating the first rotating body 31 and the conveying sheet 51 integrally. Additionally, before rotating the conveying sheet 51, it is possible to disintegrate the toner in the compressed state with the rotation of the first rotating body 31. Therefore, even when the first rotating body 31 presses and rotates the second rotating body 32, it is possible to reduce the torque required for rotating the toner stirring section 13. Accordingly, it is possible to prevent a motor for rotating the toner stirring section 13 from losing synchronism or being broken effectively.

Further, it is possible to reduce the torque required for rotating the toner stirring section 13 so that it is possible to employ a miniature motor whose rated torque is small as a motor to be mounted on the main body of the image forming apparatus in order to rotate the toner stirring section 13. In other words, even when the motor whose rated torque is small is employed, it is possible to prevent the motor from losing synchronism or being broken. Therefore, it is possible to realize an economical image forming apparatus.

Figure 15:
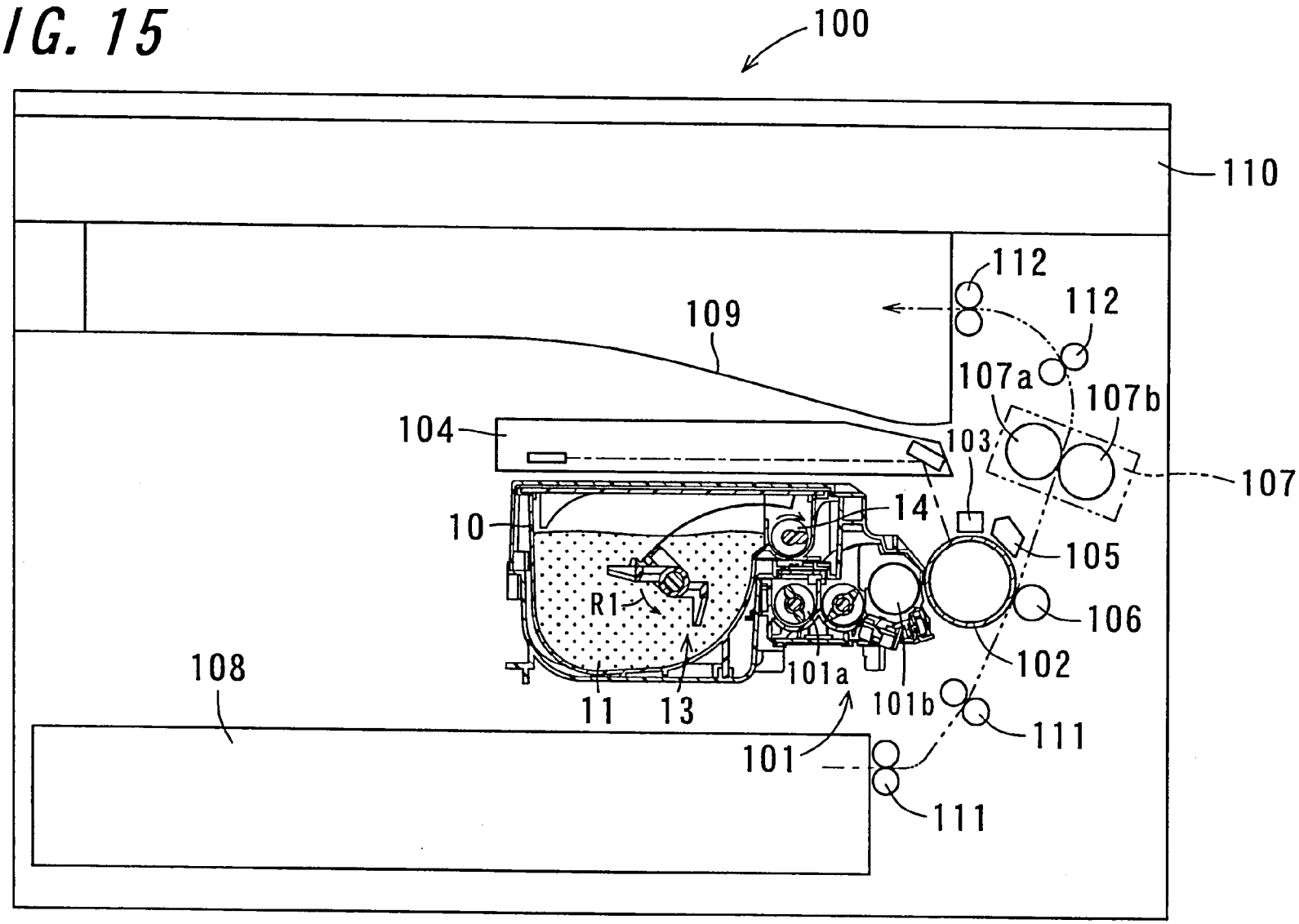
FIG. 15 is a sectional view schematically showing the image forming apparatus provided with a toner cartridge according to the embodiment.
Figure 16:
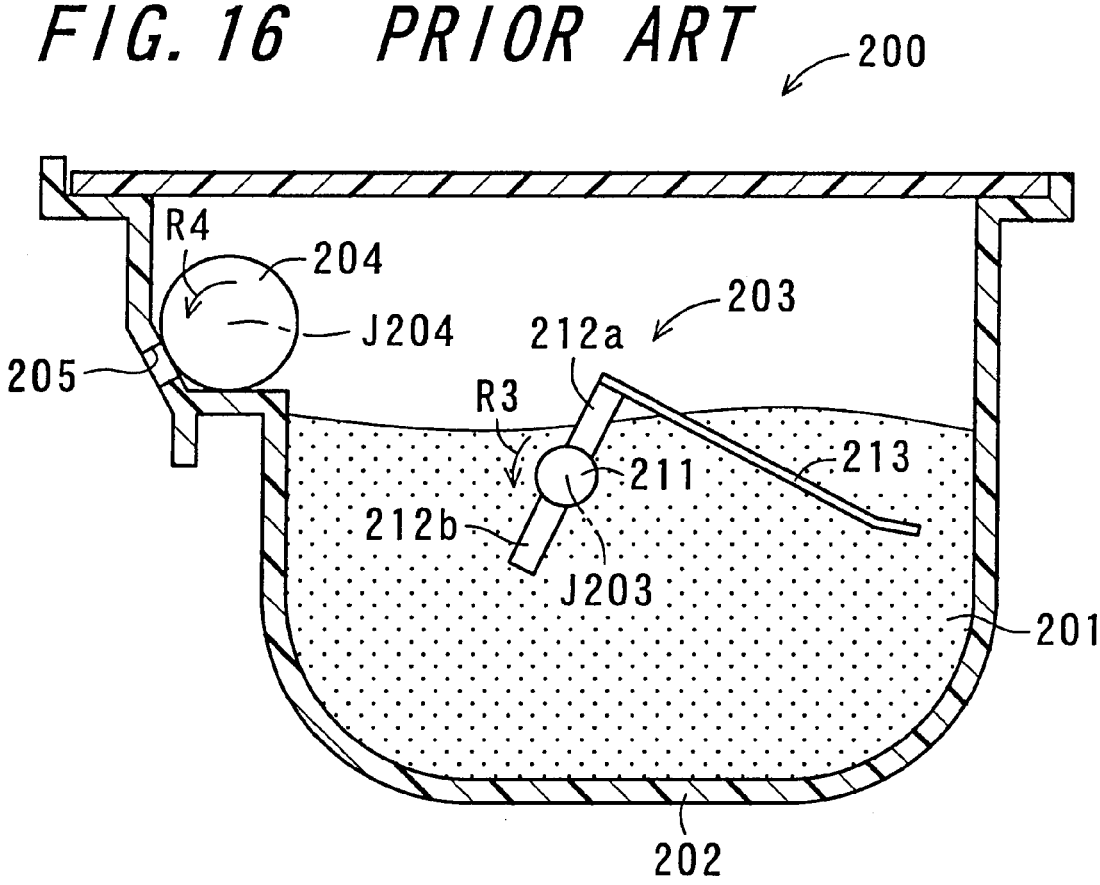
FIG. 16 PRIOR ART
FIG. 16 is a cross-sectional view showing an unused toner cartridge according to the conventional art.

FIG. 15 is a sectional view schematically showing the image forming apparatus 100 provided with a toner cartridge 10 according to the embodiment.

The image forming apparatus 100 is provided with the toner cartridge 10, a developing device 101, a photoreceptor drum 102, a charging device 103, an exposure device 104, a cleaning device 105, a transfer device 106, a fixing device 107, a paper feed cassette 108, a catch tray 109 and a scanner unit 110.

The developing device 101 includes a stirring roller 101*a*, a developing roller 101*b*, a developer tank, a regulating member and a toner density detecting sensor.

The developer tank is a tubular container member having an internal space, rotatably supports the stirring roller 101*a* and the developing roller 101*b* and contains a two-component developer composed of a toner and a carrier. The developer tank has a first opening section communicating with a toner replenishing port 21*f* of the toner cartridge 10 attached inside a casing of the image forming apparatus 100 as well as has a second opening section at a position opposing the photoreceptor drum 102. Additionally, inside the developer tank, the stirring roller 101*a* is rotatably arranged on the side of the first opening section, and the developing roller 101*b* is arranged on the side of the second opening section.

The stirring roller 101*a* is rotated by a driving section (not shown), and stirs the two-component developer contained in the developer tank.

The developing roller 101*b* coveys the two-component developer to the photoreceptor drum 102, and is a roller-like member rotated by a driving section (not shown). Additionally, the developing roller 101*b* opposes the photoreceptor drum 102 through the second opening section of the developer tank, and is provided so as to depart from the photoreceptor drum 102.

The two-component developer conveyed by the developing roller 101*b* contacts with the photoreceptor drum 102 at a closest position. This contact region is a developing nip region. In the developing nip region, from a power source (not shown) connected to the developing roller 101*b*, a developing bias voltage is applied to the developing roller 101*b*, and a toner is supplied to an electrostatic latent image on the surface of the photoreceptor drum 102 from the surface of the developing roller 101*b*.

The regulating member is a rectangular plate-like body, and an end edge thereof is close to an outer circumferential surface of the developing roller 101*b* with a narrow space. As a material of the regulating member, stainless steel is usable, and aluminum and a synthetic resin are also usable.

The toner density detecting sensor is attached on the bottom surface of the developer tank and at a downward position in the vertical direction of the stirring roller 101*a*, and is provided so that a sensor surface is exposed inside the developer tank. The toner density detecting sensor is electrically connected to a control section (not shown).

The control section rotates the toner replenishing roller 14 of the toner cartridge 10 corresponding to a detection result with the toner density detecting sensor, and controls so that a toner is supplied to the developing device 101 through the toner replenishing port 21*f*.

This control section, in the case of determining that the detection result with the toner density detecting sensor is lower than a toner density set value, sends a control signal to the driving section rotating the toner replenishing roller 14 and rotates the toner replenishing roller 14.

The toner density detecting sensor is not particularly limited, and examples thereof include a transmitted light detecting sensor, a reflected light detecting sensor and a magnetic permeability detecting sensor. Among them, the magnetic permeability detecting sensor is preferred.

The photoreceptor drum 102 is rotatably supported around an axis by a driving section (not shown) inside the casing of the image forming apparatus 100, and is a roller-like member in which an electrostatic latent image and a toner image are continuously formed on a surface thereof. For the photoreceptor drum 102, for example, a roller-like member with photosensitive layers layered on the surface of a conductive substrate (not shown) is able to be used. As the conductive substrate, a conductive substrate in a shape such as a cylindrical shape, a columnar shape or a sheet shape is able to be used, and among them, a cylindrical conductive substrate is preferred. As the photosensitive layer, an organic photosensitive layer, an inorganic photosensitive layer and the like are included.

As the organic photosensitive layer, there is included a layered photoreceptor composed of a charge generating layer which is a resin layer containing a charge generating substance and a charge transporting layer which is a resin layer containing a charge transporting substance, or a single layer type photoreceptor containing a charge generating substance and a charge transporting substance in a single resin layer. As the inorganic photosensitive layer, there are included a film containing one type or two types or more selected from zinc oxide, selenium, amorphous silicon and the like.

In the photoreceptor drum 102, between the conductive substrate and the photosensitive layer, a base film may be stood, and a surface film (protective film) may be provided on the surface of the photosensitive layer mainly for protecting the surface.

The charging device 103 is a pin array charging device for performing corona discharging to the photoreceptor drum 102. To the charging device 103, a power source (not shown) is connected for applying voltage. The charging device 103, by being subjected to application of voltage from the power source, charges the surface of the photoreceptor drum 102 to predetermined polarity and potential. As the charging device 103, a charger-type charging device, a charging-brush type charging device, a roller-type charging device, a contact-type charging device such as a magnetic brush or the like is able to be used, except for the pin array charging device.

In the exposure device 104, image information of a document read by the scanner unit 110 or image information from an external device is inputted, and the surface of the photoreceptor drum 102 in a charged state is irradiated with a light signal corresponding to the image information. Thereby, an electrostatic latent image corresponding to the image information is formed on the surface of the photoreceptor drum 102. As the exposure device 104, a laser scanning device containing a light source is used.

The laser scanning device is, for example, a device combined with a light source, a polygonal mirror, a fθ lens, a reflective mirror and the like. As the light source, for example, a semiconductor laser, an LED array, an electroluminescence (EL) element and the like are able to be used.

The transfer device 106 is rotatably provided by a supporting member and the driving section, which are not shown, inside the casing of the image forming apparatus 100, and is a roller-like member arranged so as to be in pressure-contact with the surface of the photoreceptor drum 102 with a recording medium interposed therebetween. For the transfer device 106, for example, a roller-like member having a metal core whose diameter is 8 to 10 mm and conductive elastic layers layered on a surface of the metal core is able to be used.

As metal forming the metal core, stainless steel, aluminum and the like are able to be used. As the conductive elastic layer, a rubber material containing a combination of a rubber material such as ethylene-propylene rubber (EPDM), expanded EPDM, or urethane foam, and a conductive material such as carbon black is able to be used.

In synchronization with conveyance of a toner image with the rotation of the photoreceptor drum 102 to a pressure-contact part (transfer nip region) with the photoreceptor drum 102 and the transfer device 106, a recording medium is supplied one by one via paper feed rollers 111 from the paper feed cassette 108.

The recording medium is passed through the transfer nip region, and thereby the toner image on the surface of the photoreceptor drum 102 is transferred to the recording medium. To the transfer device 106, a power source (not shown) is connected, and when the toner image is transferred to the recording medium, voltage whose polarity is opposite to charging polarity of the toner comprising the toner image is applied to the transfer device 106. Thereby, the toner image is transferred smoothly to the recording medium.

The cleaning device 105 includes a cleaning blade and a toner reservoir which are not shown. The cleaning blade is a rectangular elastic plate material extendedly provided in parallel in a long side direction of the photoreceptor drum 102, and one end on the long side is installed along an opening section of the toner reservoir so that the other end on the long side contacts with the surface of the photoreceptor drum 102. The cleaning blade removes a toner, paper powder and the like remained on the surface of the photoreceptor drum 102 after transferring the toner image to the recording medium. The toner reservoir is a container-like member having an internal space, and guides the toner to be removed by the cleaning blade to the inside from the opening section to reserve temporally. With this cleaning device 105, the surface of the photoreceptor drum 102 after transferring the toner image is cleaned.

The fixing device 107 has a fixing roller 107*a* and a pressure roller 107*b*. The fixing roller 107*a* is a roller-like member rotatably provided around an axis thereof by a supporting member and a driving section which are not shown.

The fixing roller 107*a* has a heating member (not shown) inside thereof, heats and fuses a toner comprising an unfixed toner image carried on the recording medium conveyed from the transfer nip region to be fixed to the recording medium. As the fixing roller 107*a*, for example, a roller-like member having a metal core and an elastic layer which is covered with the metal core is able to be used. The metal core is formed of metal such as iron, stainless steel, or aluminum. The elastic layer, for example, is formed of an elastic material such as silicone rubber, or fluororubber. The heating member is subjected to application of voltage from a power source (not shown) to be heated, and for example, a halogen lamp, an infrared lamp or the like is able to be used therefor.

The pressure roller 107*b* is a roller-like member rotatably supported inside the casing and provided so as to be in pressure-contact with the fixing roller 107*a* by a pressure member (not shown), and is driven to rotate along with the rotation of the fixing roller 107*a*. A pressure-contact part of the fixing roller 107*a* and the pressure roller 107*b* is a fixing nip region. The pressure roller 107*b* presses a toner in a fused state against the recording medium when a toner image is heated and fixed to the recording medium by the fixing roller 107*a* so that fixation of the toner image to the recording medium is promoted. As the pressure roller 107*b*, a roller-like member in the same configuration as that of the fixing roller 107*a* is able to be used, and further, a heating member may be provided inside thereof. As this heating member, the same one as the heating member inside the fixing roller 107*a* is able to be used.

The recording medium to which a toner image is transferred passes through the fixing nip region of the fixing device 107, thereby the toner comprising the toner image is fused to be pressed against the recording medium, the toner image is fixed to the recording medium, and the recording medium on which an image is printed is discharged to the catch tray 109 via discharge rollers 112.

The paper feed cassette 108 is a tray containing a recording medium such as plain paper, coated paper, color copy sheet, or an OHP film. A pick-up roller and conveying rollers, which are not shown, are provided on the downstream side of sheet conveyance of the paper feed cassette 108, and in synchronization with conveyance of the toner image on the surface of the photoreceptor drum 102 to the transfer nip region, the recording medium is fed one by one by to the transfer nip region by the pick-up roller and the conveying rollers.

The scanner unit 110 includes a document set tray, a reversing automatic document feeder (hereinafter, referred to as "RADF") and a document reading device, which are not shown. The RADF conveys a document placed on the document set tray to a document platen provided in the document reading device. The document reading device includes the document platen, a document scanning device, a reflective member, a charge coupled device (hereinafter, referred to as "CCD") line sensor and the like, and reads image information of the document placed on the document platen per a plurality of lines, for example, per 10 lines. The document platen is a glass plate-like member for placing thereon a document having image information to be read.

The document scanning device has a light source and a first reflective mirror which are not shown, reciprocates at a constant speed V in parallel along a lower surface in the vertical direction of the document platen, and irradiates an image forming surface of the document placed on the document platen with light. A reflected image of light is obtained by irradiation of light. The light source is a light source of light with which the document placed on the document platen is irradiated. The first reflective mirror reflects the reflected image of light toward the reflective member. The reflective member has a second reflective mirror (not shown), a third reflective mirror and an optical lens, and forms the reflected image of light obtained with the document scanning device on the CCD line sensor. The reflective member follows reciprocation of the document scanning device to reciprocate at a V/2 speed. The second and the third reflective mirrors reflect the reflected image of light so that the reflected image of light heads to the optical lens. The optical lens forms the reflected image of light on the CCD line sensor.

The CCD line sensor has a CCD circuit (not shown) for photoelectrically converting the reflected image of light to be formed with the optical lens to an electric signal, and outputs the electric signal that is image information to an image processing section in the control section. The image processing section converts image information to be inputted from the document reading device or an external device such as a personal computer to the electric signal to output it to the exposure device 104.

A toner cartridge according to the invention is able to be attached, not limited to the image forming apparatus 100 as shown in FIG. 15, and to an image forming apparatus with use of an electrophotography such as a copier, a printer and a facsimile. The toner cartridge according to the invention is able to reduce torque required for rotating the toner stirring section in a toner cartridge in an initial state so that the image forming apparatus provided with the toner cartridge according to the invention is able to employ a miniature motor whose rated torque is small as a motor to be mounted on the main body of the image forming apparatus in order to rotate the toner stirring section. In other words, even when the miniature motor whose rated torque is small is employed, when the toner stirring section of the toner cartridge in the initial state is rotated, it is possible to prevent the motor from losing synchronism or being broken. Therefore, it is possible to realize an economical image forming apparatus.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner cartridge comprising a casing which contains a toner; and a toner stirring section which is rotatably provided around a predetermined axis in the casing, stirs the toner contained in the casing to convey to a conveying destination, the toner stirring section including:

a first rotating body which is rotated around the axis and stirs the toner contained in the casing; and a second rotating body which is provided with a conveying sheet for conveying the toner to the conveying destination and is rotated around the axis by being pressed by the first rotating body which is rotated and conveys the toner contained in the casing to the conveying destination, the first rotating body being provided so as to press the second rotating body after rotating by a predetermined degree relative to the second rotating body, wherein the first rotating body and the second rotating body are configured to be capable of engaging with each other and an engaged state is released when torque which is imparted to rotate the toner stirring section in the engaged state is a predetermined value or more, wherein the first rotating body has a pressing section provided apart from the axis and in parallel with the axis, and configured to press the second rotating body, and a plurality of toner disintegrating blades which protrude in a direction departing from the axis and is provided along the axis at intervals, the plurality of toner disintegrating blades comprising a plurality of first toner disintegrating blades disposed apart from the pressing section in a rotating direction around the axis and adjacent to the second rotating body in the rotation direction, and configured to engage with the second rotating body, and a plurality of second toner disintegrating blades disposed on the pressing section, wherein the conveying sheet is provided, in the second rotating body, so as to extend toward an upstream side of the rotation direction, and wherein the plurality of second toner disintegrating blades are disposed so as to protrude from the pressing section toward the upstream side of the rotation direction.

2. An image forming apparatus comprising the toner cartridge of claim 1.

3. The toner cartridge of claim 1, wherein the first toner disintegrating blades, the second toner disintegrating blades and the pressing section are formed to be tapered toward a downstream side of the rotational direction.

4. The toner cartridge of claim 1, wherein, in the conveying sheet, a notch extending from an end on the upstream side of the rotation direction toward a downstream side of the rotation direction is formed.

* * * * *